US008956252B2

(12) United States Patent
Nakamura et al.

(10) Patent No.: US 8,956,252 B2
(45) Date of Patent: Feb. 17, 2015

(54) GOLF BALL

(75) Inventors: Hirotaka Nakamura, Kobe (JP); Kazuhiko Isogawa, Kobe (JP); Seiichiro Endo, Kobe (JP); Hyoungchol Kim, Kobe (JP)

(73) Assignee: SRI Sports Limited, Kobe (JP)

( * ) Notice: Subject to any disclaimer, the term of this patent is extended or adjusted under 35 U.S.C. 154(b) by 662 days.

(21) Appl. No.: 13/166,899

(22) Filed: Jun. 23, 2011

(65) Prior Publication Data

US 2012/0010024 A1 Jan. 12, 2012

(30) Foreign Application Priority Data

Jul. 8, 2010 (JP) ..... 2010-155355

(51) Int. Cl.
*A63B 37/14* (2006.01)
*A63B 37/00* (2006.01)

(52) U.S. Cl.
CPC ..... *A63B 37/0018* (2013.01); *A63B 37/0019* (2013.01); *A63B 37/0062* (2013.01); *A63B 37/0074* (2013.01); *A63B 37/0092* (2013.01)
USPC ..... 473/383; 473/371; 473/384

(58) Field of Classification Search
USPC ..... 473/371, 383, 384
See application file for complete search history.

(56) References Cited

U.S. PATENT DOCUMENTS 4,681,323 A * 7/1987 Alaki et al. ..... 473/384
4,787,638 A * 11/1988 Kobayashi ..... 473/383
5,072,944 A 12/1991 Nakahara et al.
5,403,010 A * 4/1995 Yabuki et al. ..... 473/372
5,516,110 A 5/1996 Yabuki et al.
5,562,287 A 10/1996 Endo et al.
6,039,660 A 3/2000 Kasashima et al.
6,162,136 A 12/2000 Aoyama
6,547,678 B2 * 4/2003 Barfield ..... 473/383
6,558,274 B1 * 5/2003 Shimosaka ..... 473/351
6,599,204 B2 * 7/2003 Kasashima et al. ..... 473/383
6,626,772 B1 * 9/2003 Kennedy, III ..... 473/384
7,250,012 B1 7/2007 Simonds et al.
2002/0019269 A1 * 2/2002 Watanabe ..... 473/370

(Continued)

FOREIGN PATENT DOCUMENTS

JP 11-57065 A 3/1999
JP 2006-218294 A 8/2006

(Continued)

*Primary Examiner* — Gene Kim
*Assistant Examiner* — John E Simms, Jr.
(74) *Attorney, Agent, or Firm* — Birch, Stewart, Kolasch & Birch, LLP

(57) ABSTRACT

A golf ball 2 includes a spherical core 4 and a cover 6 positioned outside the core 4. The golf ball 2 further has dimples 8 on a surface thereof. The core 4 is obtained by crosslinking a rubber composition. The difference between a hardness H(5.0) at a point that is located at a distance of 5 mm from the central point of the core 4, and a hardness Ho at the central point is equal to or greater than 6.0. The difference between a hardness H(12.5) at a point that is located at a distance of 12.5 mm from the central point, and the hardness H(5.0) is equal to or less than 4.0. The difference between a hardness Hs at the surface of the core 4 and the hardness H(12.5) is equal to or greater than 10.0. The difference between the hardness Hs and the hardness Ho is equal to or greater than 22.0. There is no zone in which a hardness decreases from the central point to the surface. The rubber composition of the core 4 includes 2-naphthalenethiol. A cross-sectional shape of each dimple 8 is a wave-like curve.

19 Claims, 25 Drawing Sheets

(56) References Cited

U.S. PATENT DOCUMENTS

| | | | | |
|---|---|---|---|---|
| 2002/0032077 | A1 | 3/2002 | Watanabe | |
| 2003/0032501 | A1 | 2/2003 | Sakagami et al. | |
| 2003/0190968 | A1 | 10/2003 | Kasashima | |
| 2006/0178231 | A1 | 8/2006 | Kasashima | |
| 2006/0229414 | A1 | 10/2006 | Nanba et al. | |
| 2008/0004137 | A1 | 1/2008 | Kasashima et al. | |
| 2008/0194357 | A1* | 8/2008 | Higuchi | 473/373 |
| 2008/0312008 | A1 | 12/2008 | Higuchi et al. | |
| 2012/0172152 | A1* | 7/2012 | Okabe et al. | 473/373 |

FOREIGN PATENT DOCUMENTS

| | | | |
|---|---|---|---|
| JP | 2006-289074 | A | 10/2006 |
| JP | 2010-022504 | A | 2/2010 |

* cited by examiner

GOLF BALL

This application claims priority on Patent Application No. 2010-155355 filed in JAPAN on Jul. 8, 2010. The entire contents of this Japanese Patent Application are hereby incorporated by reference.

BACKGROUND OF THE INVENTION

1. Field of the Invention

The present invention relates to golf balls. Specifically, the present invention relates to golf balls including a solid core and a cover and having dimples on a surface thereof.

2. Description of the Related Art

Golf players' foremost requirement for golf balls is flight performance. Golf players place importance on flight performance upon shots with a driver, a long iron, and a middle iron. Flight performance correlates with the resilience performance of a golf ball. When a golf ball with excellent resilience performance is hit, the golf ball flies at a high speed, thereby achieving a large flight distance.

An appropriate trajectory height is required in order to achieve a large flight distance. A trajectory height depends on a spin rate and a launch angle. In a golf ball that achieves a high trajectory by a high spin rate, a flight distance is insufficient. In a golf ball that achieves a high trajectory by a high launch angle, a large flight distance is obtained. By using a core having an outer-hard/inner-soft structure, a low spin rate and a high launch angle can be achieved.

JPH2-264674 (U.S. Pat. No. 5,072,944) discloses a golf ball with a core consisting of a center core and an outer layer. The center core is flexible, and the outer layer is hard. The core suppresses a spin rate.

JPH6-98949 (U.S. Pat. No. 5,516,110) discloses a golf ball having a constant hardness between: a point that is located at a distance of 5 mm from a central point; and a point that is located at a distance of 10 mm from the central point. A similar golf ball is also disclosed in JPH6-154357 (U.S. Pat. No. 5,403,010).

JPH7-112036 (U.S. Pat. No. 5,562,287) discloses a golf ball having a small difference between a central hardness and a surface hardness of a core. The core contributes to the resilience performance of the golf ball.

JP2002-764 (US 2002/032077) discloses a golf ball having a great difference between a central hardness and a surface hardness of a core. A similar golf ball is also disclosed in JP2002-765 (US 2002/019269).

JP2003-33447 (US 2003/032501) discloses a golf ball with a core for which a rubber composition includes a polysulfide. The polysulfide contributes to the resilience performance of the golf ball.

JP2008-194473 (US 2008/194357, US 2008/312008) discloses a golf ball having a great difference between a central hardness and a surface hardness of a core. A similar golf ball is also disclosed in JP2010-22504.

Golf balls have a large number of dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. The excellent dimples produce a long flight distance.

There have been various proposals for the shapes of dimples. U.S. Pat. No. 7,250,012 discloses a golf ball that has dimples each having an annular tubular portion.

JP2001-54592 (U.S. Pat. No. 6,558,274) discloses a golf ball that has first dimples and second dimples. The second dimples are recessed from the first dimples.

JP2002-531232 (U.S. Pat. No. 6,162,136) discloses a golf ball that has dimples each having a central depression, a land ring, and an annular depression.

JP2003-290390 (US 2003/190968) discloses a golf ball that has dimples each having a projecting bottom. The curvature radius of the bottom is large.

JP2008-12300 (US 2008/004137) discloses a golf ball that has dimples each having a projection. The projection is surrounded by a ring-shaped recess.

In the golf ball disclosed in JPH2-264674, the structure of the core is complicated. The core produces an energy loss when being hit. In addition, the core has inferior durability.

In the golf ball disclosed in JPH6-98949, a range where the hardness is constant is narrow. The golf ball has inferior resilience performance. Similarly, the golf ball disclosed in JPH6-154357 also has inferior resilience performance.

In the golf ball disclosed in JPH7-112036, a spin rate is excessive. The golf ball has a small flight distance.

The golf ball disclosed in JP2002-764 has inferior resilience performance. Similarly, the golf ball disclosed in JP2002-765 also has inferior resilience performance.

In the golf ball disclosed in JP2003-33447, a spin rate is excessive. The golf ball has inferior flight performance.

In the golf ball disclosed in JP2008-194473, there is a zone in which a hardness decreases from the central point of the core toward the surface of the core. The golf ball has inferior resilience performance. In the golf ball, a spin rate is excessive. The golf ball has inferior flight performance. Similarly, the golf ball disclosed in JP2010-22504 also has inferior flight performance.

The flight performance of the golf balls disclosed in U.S. Pat. No. 7,250,012, JP2001-54592, JP2002-531232, JP2003-290390, and JP2008-12300 is not sufficient. There is room for improvement in the conventional dimples.

An object of the present invention is to provide a golf ball having excellent flight performance.

SUMMARY OF THE INVENTION

A golf ball according to the present invention comprises a core and a cover positioned outside the core. The golf ball has a large number of dimples on a surface thereof. A difference between a JIS-C hardness H(5.0) at a point that is located at a distance of 5 mm from a central point of the core, and a JIS-C hardness Ho at the central point is equal to or greater than 6.0. A difference between a JIS-C hardness H(12.5) at a point that is located at a distance of 12.5 mm from the central point, and the hardness H(5.0) is equal to or less than 4.0. A difference between a JIS-C hardness Hs at a surface of the core and the hardness H(12.5) is equal to or greater than 10.0. Each dimple has a curved surface. A cross-sectional shape of the curved surface is a wave-like curve having:

(1) one or more projections located above a circular arc that passes through one dimple edge, a deepest point of the dimple, and another dimple edge; and (2) one or more recesses located below the circular arc.

In the golf ball according to the present invention, the core has an outer-hard/inner-soft hardness distribution. The core has a low energy loss when being hit. The golf ball has excellent resilience performance. When the golf ball is hit with a driver, the spin rate is low. In addition, in the golf ball, since the cross-sectional shape of each dimple is a wave-like shape, drag is small at the initial stage of a trajectory, and a lift force is great at the latter stage of the trajectory. The golf ball has excellent flight performance. In the golf ball, the great resilience performance, the low spin rate, and the excellent aerodynamic characteristic achieve a large flight distance. A general golf ball including a core having an outer-hard/inner-soft structure has a high launch angle, and thus the golf ball tends to rise during flight in a situation where a headwind blows. In the golf ball according to the present invention, the dimples, of each of which the cross-sectional shape is a wave-like shape, suppress the rising of the golf ball. A general golf ball having dimples of each of which a cross-sectional shape is a wave-like shape tends to drop at the initial stage of a trajectory. In the golf ball according to the present invention, the core having the outer-hard/inner-soft structure suppresses the dropping of the golf ball.

Preferably, a ratio of a distance between the dimple edge and a peak of a projection closest to the dimple edge, to a radius of the dimple, is equal to or greater than 20% but equal to or less than 70%. Preferably, one recess is present between the dimple edge and a projection closest to the dimple edge.

Preferably, the wave-like curve is obtained by combining a sine curve and a circular arc. Preferably, a number of cycles of the wave-like curve is equal to or greater than 2.0 but equal to or less than 6.0. Preferably, a ratio (WL/D) of a wavelength WL of the sine curve to a length D of a chord of the circular arc is equal to or greater than 1/6 but equal to or less than 1/2.

The wave-like curve may be obtained by combining a cosine curve and a circular arc. Preferably, a number of cycles of the wave-like curve is equal to or greater than 2.5 but equal to or less than 7.0. Preferably, a ratio of an amplitude of the cosine curve to a depth of the circular arc is equal to or greater than 5% but equal to or less than 50%. Preferably, a ratio (WL/D) of a wavelength WL of the cosine curve to a length D of a chord of the circular arc is equal to or greater than 1/7 but equal to or less than 1/2.5.

Preferably, the wave-like curve has 3 to 7 projections.

Preferably, a difference between the hardness Hs and the hardness Ho is equal to or greater than 22.0. Preferably, there is no zone in which a hardness decreases from the central point toward the surface of the core.

The core can be formed by crosslinking a rubber composition including a base rubber and an organic sulfur compound. Preferably, the organic sulfur compound has a molecular weight of 150 or higher but 200 or lower and a melting point of 65° C. or higher but 90° C. or lower. Preferably, the rubber composition includes the base rubber in an amount of 100 parts by weight, and the organic sulfur compound in an amount that is equal to or greater than 0.03 parts by weight but equal to or less than 3.5 parts by weight. Preferably, the sulfur compound is 2-naphthalenethiol.

Preferably, the hardness Ho is equal to or greater than 40.0 but equal to or less than 70.0, and the hardness Hs is equal to or greater than 78.0 but equal to or less than 95.0. Preferably, the hardness H(5.0) is equal to or greater than 63.0 but equal to or less than 73.0. Preferably, the hardness H(12.5) is equal to or greater than 64.0 but equal to or less than 76.0.

DESCRIPTION OF THE PREFERRED EMBODIMENTS

The following will describe in detail the present invention based on preferred embodiments with reference to the accompanying drawings.

Figure 1:
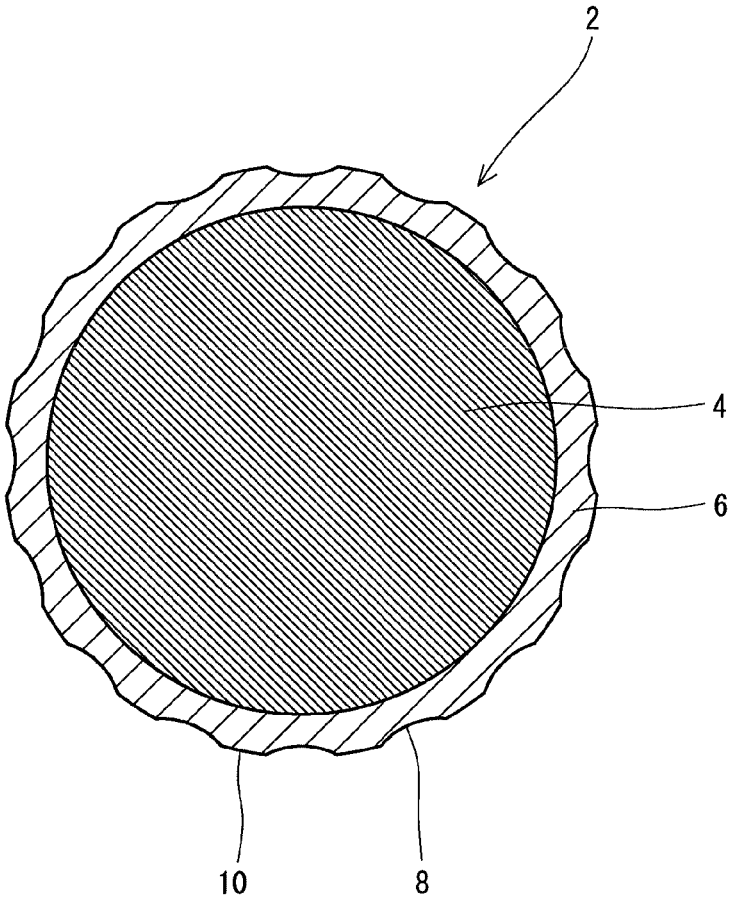
FIG. 1 is a cross-sectional view of a golf ball according to an embodiment of the present invention.
Figure 2:
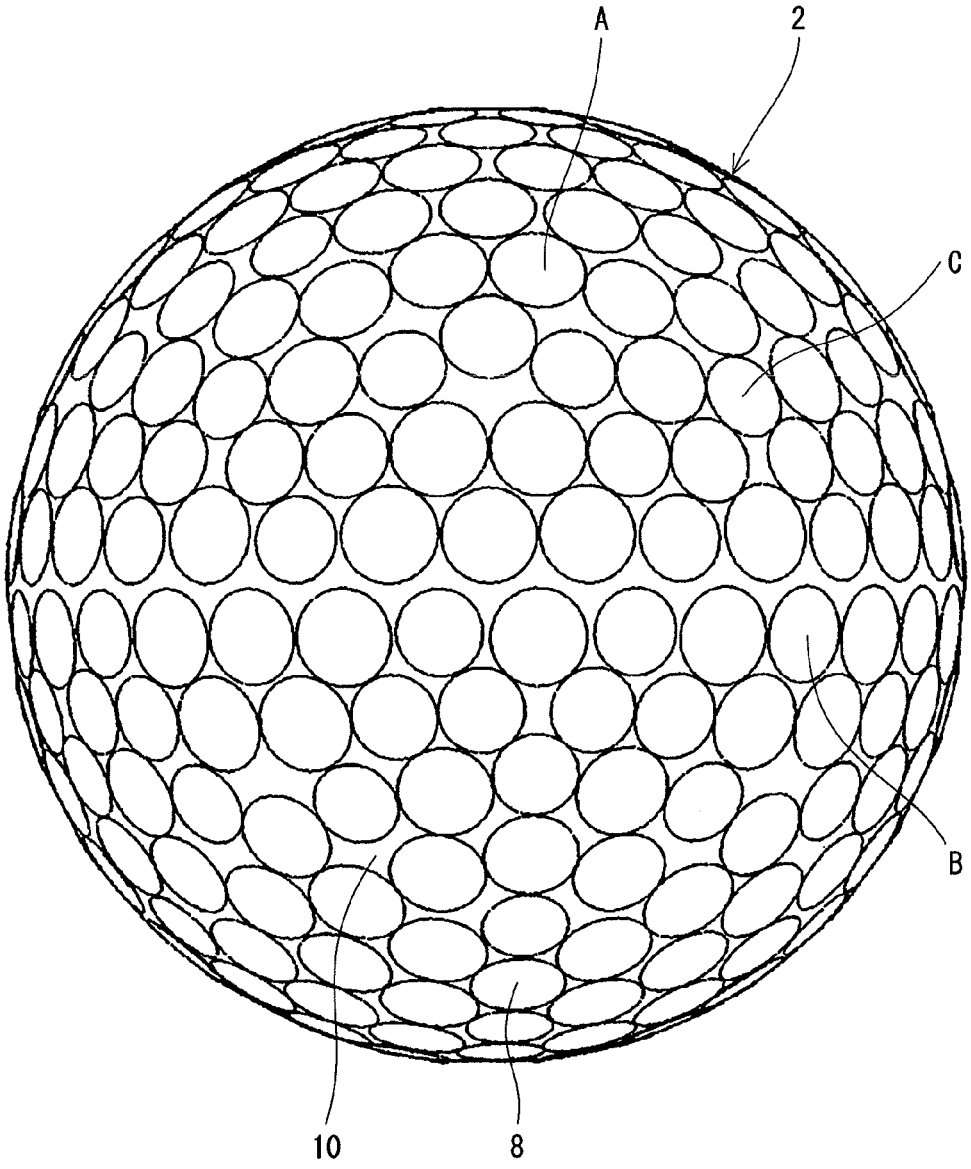
FIG. 2 is an enlarged front view of the golf ball in FIG. 1.
Figure 3:
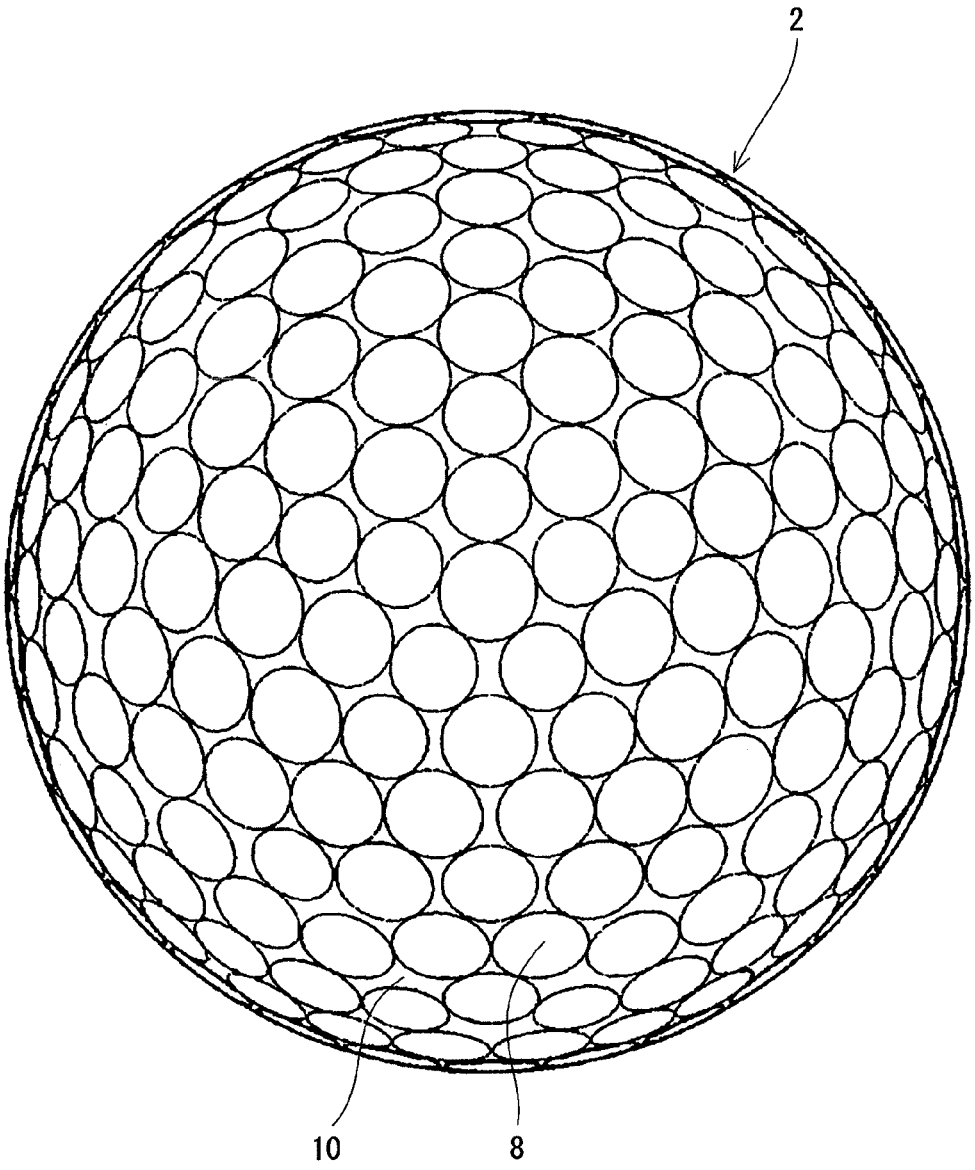
FIG. 3 is a plan view of the golf ball in FIG. 2.

A golf ball 2 shown in FIGS. 1 to 3 includes a spherical core 4 and a cover 6 positioned outside the core 4. On the surface of the cover 6, a large number of dimples 8 are formed. Of the surface of the golf ball 2, apart other than the dimples 8 is a land 10. The golf ball 2 includes a paint layer and a mark layer on the external side of the cover 6 although these layers are not shown in the drawing.

The golf ball 2 has a diameter of 40 mm or greater but 45 mm or less. From the standpoint of conformity to the rules established by the United States Golf Association (USGA), the diameter is preferably equal to or greater than 42.67 mm. In light of suppression of air resistance, the diameter is preferably equal to or less than 44 mm and more preferably equal to or less than 42.80 mm. The golf ball 2 has a weight of 40 g or greater but 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

In the present invention, a JIS-C hardness at a point that is located at a distance of x (mm) from the central point of the core 4 is indicated by H(x). In the present invention, a hardness at the central point of the core 4 is indicated by Ho, and a surface hardness of the core 4 is indicated by Hs.

The hardness Ho and the hardness H(x) are measured by pressing a JIS-C type hardness scale against a cut plane of the core 4 that has been cut into two halves. For the measurement, an automated rubber hardness measurement machine (trade name "P1", manufactured by Kobunshi Keiki Co., Ltd.), to which this hardness scale is mounted, is used. The surface hardness Hs is measured by pressing a JIS-C type hardness scale against the surface of the core 4. For the measurement, an automated rubber hardness measurement machine (trade name "P1", manufactured by Kobunshi Keiki Co., Ltd.), to which this hardness scale is mounted, is used.

Figure 4:
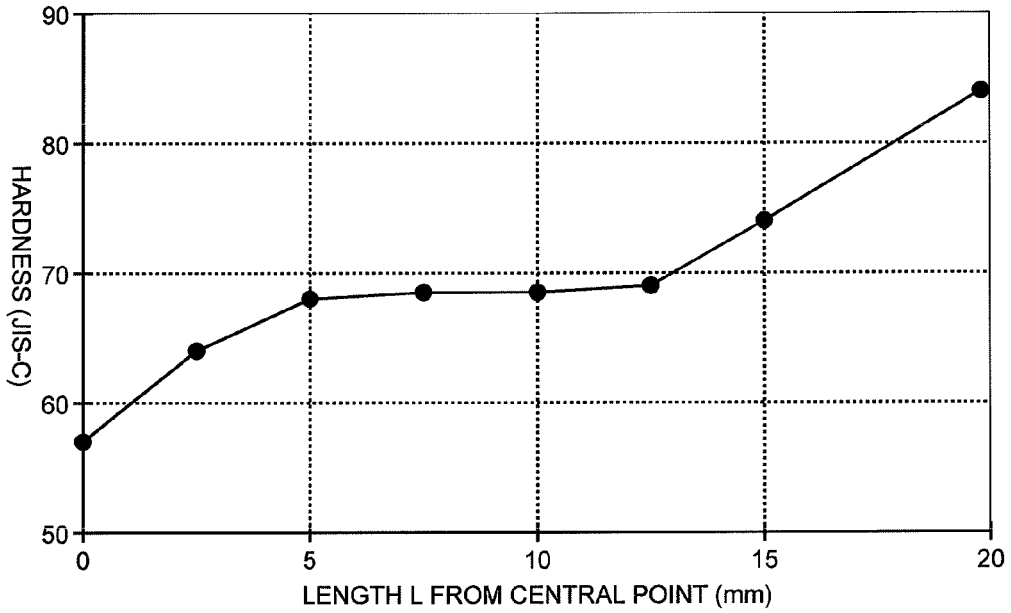
FIG. 4 is a graph showing a hardness distribution of a core of the golf ball in FIG. 1.

FIG. 4 shows a hardness distribution of the core 4. In this embodiment, the core 4 has a diameter of 39.6 mm. Thus, in FIG. 4, a hardness at a point that is located at a distance of 19.8 mm from the central point is the hardness Hs at the surface. As is obvious from FIG. 4, in the core 4, there is no zone in which the hardness decreases from the central point toward the surface. The core 4 has an outer-hard/inner-soft structure. The core 4 has a low energy loss when being hit. The core 4 has excellent resilience performance. In the core 4, spin is suppressed. The core 4 contributes to the flight performance of the golf ball 2.

As shown in FIG. 4, in this embodiment, a hardness H(5.0) is 68.0, and the hardness Ho is 57.0. The difference (H (5.0)−Ho) between the hardness H(5.0) and the hardness Ho is 11.0. The difference (H (5.0)−Ho) is great. In the golf ball 2 in which the difference (H(5.0)−Ho) is great, a spin rate is low when the golf ball 2 is hit with a driver. The low spin rate can achieve a large flight distance. In light of suppression of spin, the difference (H(5.0)−Ho) is preferably equal to or greater than 6.0 and particularly preferably equal to or greater than 8.0. In light of ease of producing the core 4, the difference (H(5.0)−Ho) is preferably equal to or less than 15.0.

As shown in FIG. 4, in this embodiment, a hardness H(12.5) is 69.0, and the hardness H(5.0) is 68.0. The difference (H(12.5)−H(5.0)) between the hardness H(12.5) and the hardness H(5.0) is 1.0. The difference (H(12.5)−H(5.0)) is small. In the core 4, the hardness distribution curve is almost flat between: a point that is located at a distance of 5.0 mm from the central point; and a point that is located at a distance of 12.5 mm from the central point. In the golf ball 2 in which the difference (H(12.5)−H(5.0)) is small, an energy loss is low when the golf ball 2 is hit with a driver. The golf ball 2 has excellent resilience performance. In light of resilience performance, the difference (H(12.5)−H(5.0)) is preferably equal to or greater than 0.0 but equal to or less than 4.0, more preferably equal to or greater than 0.5 but equal to or less than 3.0, and particularly preferably equal to or greater than 0.5 but equal to or less than 1.5.

As shown in FIG. 4, in this embodiment, the hardness Hs is 84.0, and the hardness H(12.5) is 69.0. The difference (Hs−H(12.5)) between the hardness Hs and the hardness H(12.5) is 15.0. The difference (Hs−H(12.5)) is great. In the golf ball 2 in which the difference (Hs−H(12.5)) is great, a spin rate is low when the golf ball 2 is hit with a driver. The low spin rate can achieve a large flight distance. In light of suppression of spin, the difference (Hs−H(12.5)) is preferably equal or greater than 10.0, more preferably equal to or greater than 13.0, and particularly preferably equal to or greater than 14.0. In light of ease of producing the core 4, the difference (Hs−H(12.5)) is preferably equal to or less than 20.0.

As described above, in this embodiment, the hardness Ho is 57.0, and the hardness Hs is 84.0. The difference (Hs−Ho) between the hardness Hs and the hardness Ho is 27.0. The difference (Hs−Ho) is great. In the golf ball 2 in which the difference (Hs−Ho) is great, a spin rate is low when the golf ball 2 is hit with a driver. The low spin rate can achieve a large flight distance. In light of suppression of spin, the difference (Hs−Ho) is preferably equal to or greater than 22.0 and particularly preferably equal to or greater than 24.0. In light of ease of producing the core 4, the difference (Hs−Ho) is preferably equal to or less than 35.0.

The hardness Ho at the central point is preferably equal to or greater than 40.0 but equal to or less than 70.0. The golf ball 2 in which the hardness Ho is equal to or greater than 40.0 has excellent resilience performance. In this respect, the hardness Ho is more preferably equal to or greater than 50.0 and particularly preferably equal to or greater than 55.0. The core 4 in which the hardness Ho is equal to or less than 70.0 can achieve an outer-hard/inner-soft structure. In the golf ball 2 with this core 4, spin can be suppressed. In this respect, the hardness Ho is more preferably equal to or less than 65.0 and particularly preferably equal to or less than 60.0.

The hardness H(5.0) is preferably equal to or greater than 63.0 but equal to or less than 73.0. The golf ball 2 in which the hardness H(5.0) is equal to or greater than 63.0 has excellent resilience performance. In this respect, the hardness H(5.0) is particularly preferably equal to or greater than 65.0. The golf ball 2 in which the hardness H(5.0) is equal to or less than 73.0 provides excellent feel at impact. In this respect, the hardness H(5.0) is particularly preferably equal to or less than 71.0.

The hardness H(12.5) is preferably equal to or greater than 64.0 but equal to or less than 76.0. The golf ball 2 in which the hardness H(12.5) is equal to or greater than 64.0 has excellent resilience performance. In this respect, the hardness H(12.5) is particularly preferably equal to or greater than 66.0. The golf ball 2 in which the hardness H(12.5) is equal to or less than 76.0 provides excellent feel at impact. In this respect, the hardness H(12.5) is particularly preferably equal to or less than 72.0.

The hardness Hs at the surface of the core 4 is preferably equal to or greater than 78.0 but equal to or less than 95.0. The core 4 in which the hardness Hs is equal to or greater than 78.0 can achieve an outer-hard/inner-soft structure. In the golf ball 2 with this core 4, spin can be suppressed. In this respect, the hardness Hs is more preferably equal to or greater than 80.0 and particularly preferably equal to or greater than 82.0. The golf ball 2 in which the hardness Hs is equal to or less than 95.0 has excellent durability. In this respect, the hardness Hs is more preferably equal to or less than 90.0 and particularly preferably equal to or less than 85.0.

The core 4 is obtained by crosslinking a rubber composition. Examples of base rubbers for use in the rubber composition of the core 4 include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

The rubber composition of the core 4 includes a co-crosslinking agent. The co-crosslinking agent achieves high resilience of the core 4. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 10 parts by weight, and more preferably equal to or greater than 25 parts by weight, per 100 parts by weight of the base rubber. In light of soft feel at impact, the amount of the co-crosslinking agent is preferably equal to or less than 50 parts by weight, and particularly preferably equal to or less than 45 parts by weight, per 100 parts by weight of the base rubber.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance of the golf ball 2, the amount of the organic peroxide is preferably equal to or greater than 0.1 parts by weight, more preferably equal to or greater than 0.2 parts by weight, and particularly preferably equal to or greater than 0.3 parts by weight, per 100 parts by weight of the base rubber. In light of soft feel at impact, the amount of the organic peroxide is preferably equal to or less than 2.0 parts by weight, more preferably equal to or less than 1.5 parts by weight, and particularly preferably equal to or less than 1.0 parts by weight, per 100 parts by weight of the base rubber.

Preferably, the rubber composition of the core 4 includes an organic sulfur compound. In light of achievement of both excellent resilience performance and a low spin rate, an organic sulfur compound having a molecular weight of 150 or higher but 200 or lower is preferred. The molecular weight is particularly preferably equal to or higher than 155. The molecular weight is particularly preferably equal to or lower than 170.

In light of achievement of both excellent resilience performance and a low spin rate, an organic sulfur compound having a melting point of 65° C. or higher but 90° C. or lower. The melting point is particularly preferably equal to or higher than 75° C. The melting point is particularly preferably equal to or lower than 85° C.

Organic sulfur compounds include naphthalenethiol type compounds, benzenethiol type compounds, and disulfide type compounds.

Examples of naphthalenethiol type compounds includes 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol type compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide type compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

From the standpoint that the core 4 having an appropriate hardness distribution is obtained, particularly preferable organic sulfur compounds are 1-naphthalenethiol and 2-naphthalenethiol. The molecular weight of each of 1-naphthalenethiol and 2-naphthalenethiol is 160.2. The melting point of 2-naphthalenethiol is 79° C. to 81° C.

The most preferable organic sulfur compound is 2-naphthalenethiol. The chemical formula of 2-naphthalenethiol is shown below.

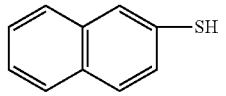

From the standpoint that the core 4 having an appropriate hardness distribution is obtained, the amount of the organic sulfur compound is preferably equal to or greater than 0.03 parts by weight, more preferably equal to or greater than 0.05 parts by weight, and particularly preferably equal to or greater than 0.08 parts by weight, per 100 parts by weight of the base rubber. In light of resilience performance, the amount of the organic sulfur compound is preferably equal to or less than 5.0 parts by weight, more preferably equal to or less than 3.5 parts by weight, and particularly preferably equal to or less than 3.0 parts by weight, per 100 parts by weight of the base rubber.

For the purpose of adjusting specific gravity and the like, a filler may be included in the core 4. Examples of suitable fillers include zinc oxide, barium sulfate, calcium carbonate, and magnesium carbonate. The amount of the filler is determined as appropriate so that the intended specific gravity of the core 4 is accomplished. A particularly preferable filler is zinc oxide. Zinc oxide serves not only as a specific gravity adjuster but also as a crosslinking activator.

According to need, an anti-aging agent, a coloring agent, a plasticizer, a dispersant, sulfur, a vulcanization accelerator, and the like are added to the rubber composition of the core 4. Crosslinked rubber powder or synthetic resin powder may be also dispersed in the rubber composition.

The core 4 has a diameter of preferably 34 mm or greater but 42 mm or less. The core 4 having a diameter of 34 mm or greater can achieve excellent resilience performance of the golf ball 2. In this respect, the diameter is more preferably equal to or greater than 36 mm and particularly preferably equal to or greater than 38 mm. In the golf ball 2 with the core 4 having a diameter of 42 mm or less, the cover 6 can have a sufficient thickness. The golf ball 2 with the cover 6 having a large thickness has excellent durability. In this respect, the diameter is more preferably equal to or less than 41 mm and particularly preferably equal to or less than 40 mm.

A resin composition is suitably used for the cover 6. Examples of the base polymer of the resin composition include ionomer resins, styrene block-containing thermoplastic elastomers, thermoplastic polyester elastomers, thermoplastic polyamide elastomers, thermoplastic polyolefin elastomers, and thermoplastic polyurethane elastomers.

Particularly preferable base polymers are ionomer resins. The golf ball 2 with the cover 6 including an ionomer resin has excellent resilience performance. An ionomer resin and another resin may be used in combination for the cover 6. In this case, the principal component of the base polymer is preferably the ionomer resin. Specifically, the proportion of the ionomer resin to the entire base polymer is preferably equal to or greater than 50% by weight, more preferably equal to or greater than 70% by weight, and particularly preferably equal to or greater than 80% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan MK7320", and "Himilan MK7329", manufactured by Du Pont-MITSUI POLYCHEMICALS Co., Ltd.; trade names-"Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and"HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by Exxon Mobil Chemical Corporation.

Two or more types of ionomer resins may be used in combination for the cover 6. An ionomer resin neutralized with a monovalent metal ion, and an ionomer resin neutralized with a bivalent metal ion may be used in combination.

A preferable resin that can be used in combination with an ionomer resin is a styrene block-containing thermoplastic elastomer. The styrene block-containing thermoplastic elastomer has excellent compatibility with ionomer resins. A resin composition including the styrene block-containing thermoplastic elastomer has excellent fluidity.

The styrene block-containing thermoplastic elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include alloys of olefin and one or more types selected from the group consisting of SBS, SIS, SIBS, SEBS, SEPS, SEEPS, and hydrogenated products thereof. The olefin component in the alloy is presumed to contribute to improvement of compatibility with ionomer resins. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 6 in an adequate amount.

The cover 6 has a Shore D hardness of preferably 50 or greater but 70 or less. In the golf ball 2 with the cover 6 having a Shore D hardness of 50 or greater, spin is suppressed. The golf ball 2 has excellent flight performance. In this respect, the Shore D hardness is particularly preferably equal to or greater than 55. The golf ball 2 with the cover 6 having a Shore D hardness of 70 or less provides excellent feel at impact. In this respect, the Shore D hardness is particularly preferably equal to or less than 65.

The Shore D hardness is measured according to the standards of "ASTM-D 2240-68" with an automated rubber hardness measurement machine (trade name "P1", manufactured by Kobunshi Keiki Co., Ltd.) to which a Shore D type hardness scale is mounted. For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the cover 6 is used for the measurement.

The cover 6 has a thickness of preferably 0.3 mm or greater but 3.0 mm or less. The golf ball 2 with the cover 6 having a thickness of 0.3 mm or greater has excellent durability. In this respect, the thickness is more preferably equal to or greater than 0.8 mm and particularly preferably equal to or greater than 1.0 mm. The golf ball 2 with the cover 6 having a thickness of 3.0 mm or less provides excellent feel at impact. In this respect, the thickness is more preferably equal to or less than 2.5 mm and particularly preferably equal to or less than 2.0 mm.

For forming the cover 6, known methods such as injection molding, compression molding, and the like can be used. When forming the cover 6, the dimples 8 are formed by pimples formed on the cavity face of a mold. The cover 6 may have two or more layers.

In light of feel at impact, the golf ball 2 has an amount of compressive deformation CD of preferably 2.5 mm or greater, more preferably 2.7 mm or greater, and particularly preferably 2.8 mm or greater. In light of resilience performance, the amount of compressive deformation CD is preferably equal to or less than 4.0 mm, more preferably equal to or less than 3.8 mm, and particularly preferably equal to or less than 3.6 mm.

At measurement of the amount of compressive deformation, first, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured.

As shown in FIGS. 2 and 3, the contour of the dimple 8 is circular. The golf ball 2 has dimples A each having a diameter of 4.46 mm; dimples B each having a diameter of 4.36 mm; and dimples C each having a diameter of 3.90 mm. The number of types of the dimples 8 is three. The number of the types may be one, two, or four or more. The number of the dimples A is 112; the number of the dimples B is 100; and the number of the dimples C is 120. The total number of the dimples 8 is 332.

Figure 5:
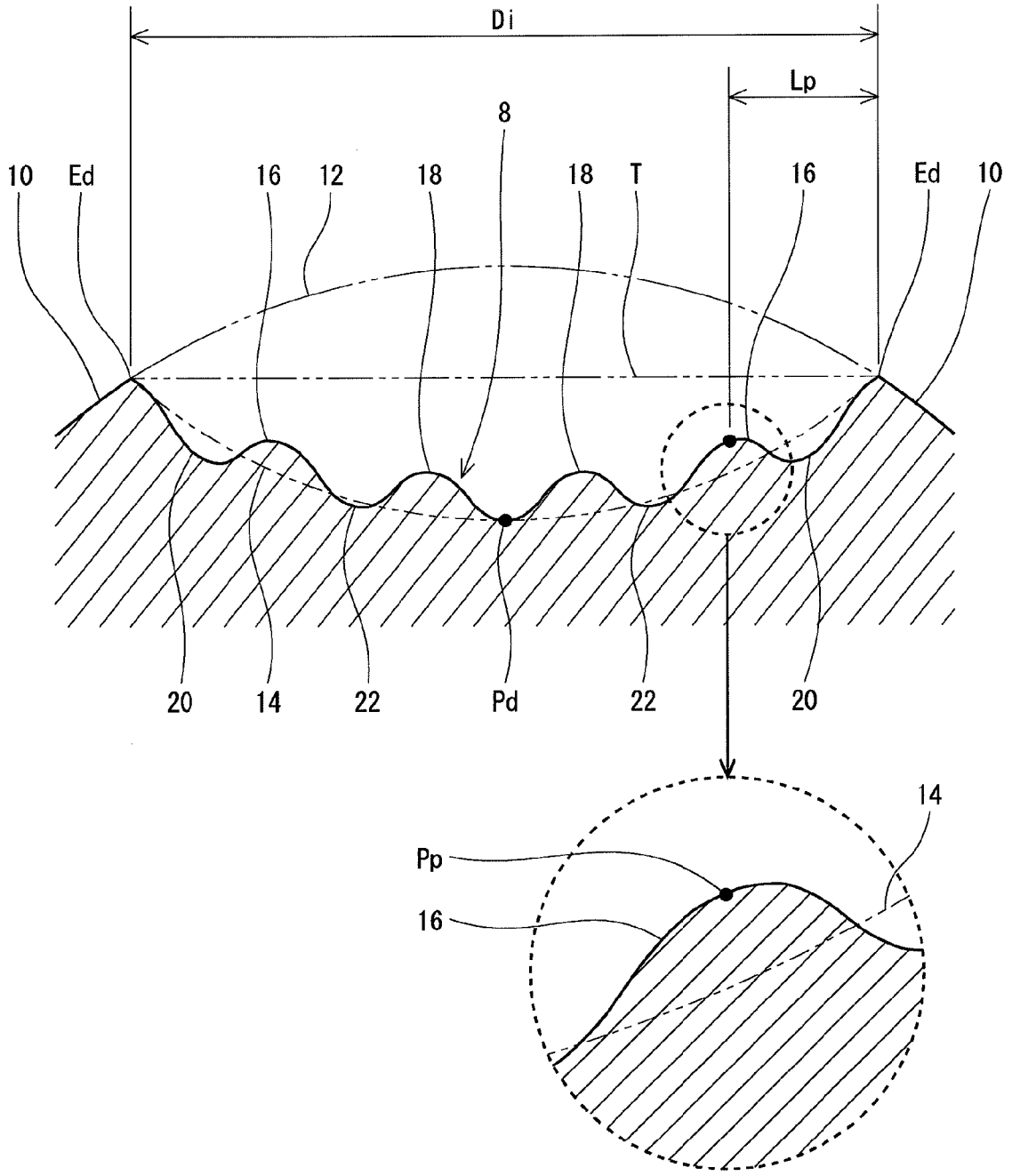
FIG. 5 is an enlarged cross-sectional view of a dimple of the golf ball in FIG. 1.

FIG. 5 shows a cross section along a plane passing through the center of the dimple 8 and the center of the golf ball 2. The dimple 8 is formed from a curved surface. In FIG. 5, the top-to-bottom direction is the depth direction of the dimple 8. In FIG. 5, what is indicated by a reference numeral 12 is the surface of a phantom sphere. The surface of the phantom sphere 12 is the surface of the golf ball 2 when it is postulated that no dimple 8 exists. The dimple 8 is recessed from the surface of the phantom sphere 12. The land 10 agrees with the surface of the phantom sphere 12.

In FIG. 5, what is indicated by a double ended arrow Di is the diameter of the dimple 8. The diameter Di is the distance between two tangent points Ed appearing on a tangent line T that is drawn tangent to the far opposite ends of the dimple 8. Each tangent point Ed is also the edge of the dimple 8. The edge Ed defines the contour of the dimple 8. The diameter Di is preferably equal to or greater than 2.0 mm but equal to or less than 6.0 mm. By setting the diameter Di to be 2.0 mm or greater, a superior dimple effect is achieved. In this respect, the diameter Di is more preferably equal to or greater than 2.50 mm and particularly preferably equal to or greater than 3.0 mm. By setting the diameter Di to be 6.0 mm or less, a fundamental feature of the golf ball 2 being substantially a sphere is not impaired. In this respect, the diameter Di is more preferably equal to or less than 5.5 mm and particularly preferably equal to or less than 5.0 mm.

As shown in FIG. 5, a cross-sectional shape of the dimple 8 is a wave-like curve. The wave-like curve extends from one edge Ed to another edge Ed. What is indicated by a reference sign Pd is the deepest point of the dimple 8. The deepest point Pd is a point, on the surface of the dimple 8, which has a largest distance from the tangent line T. What is indicated by a reference numeral 14 is a circular arc that passes through the one edge Ed, the deepest point Pd, and the other edge Ed.

The wave-like curve has two first projections 16, two second projections 18, two first recesses 20, and two second recesses 22. Each first projection 16 is located above the circular arc 14. Each second projection 18 is located above the circular arc 14. Each first recess 20 is located below the circular arc 14. Each second recess 22 is located below the circular arc 14. The circular arc 14 is a reference for discriminating between the projections and the recesses. The first recess 20, the first projection 16, the second recess 22, and the second projection 18 are arranged in this order from the edge Ed toward the deepest point Pd. The first recess 20 is adjacent to the edge Ed. The first projection 16 is closer to the edge Ed than the second projection 18.

Figure 6:
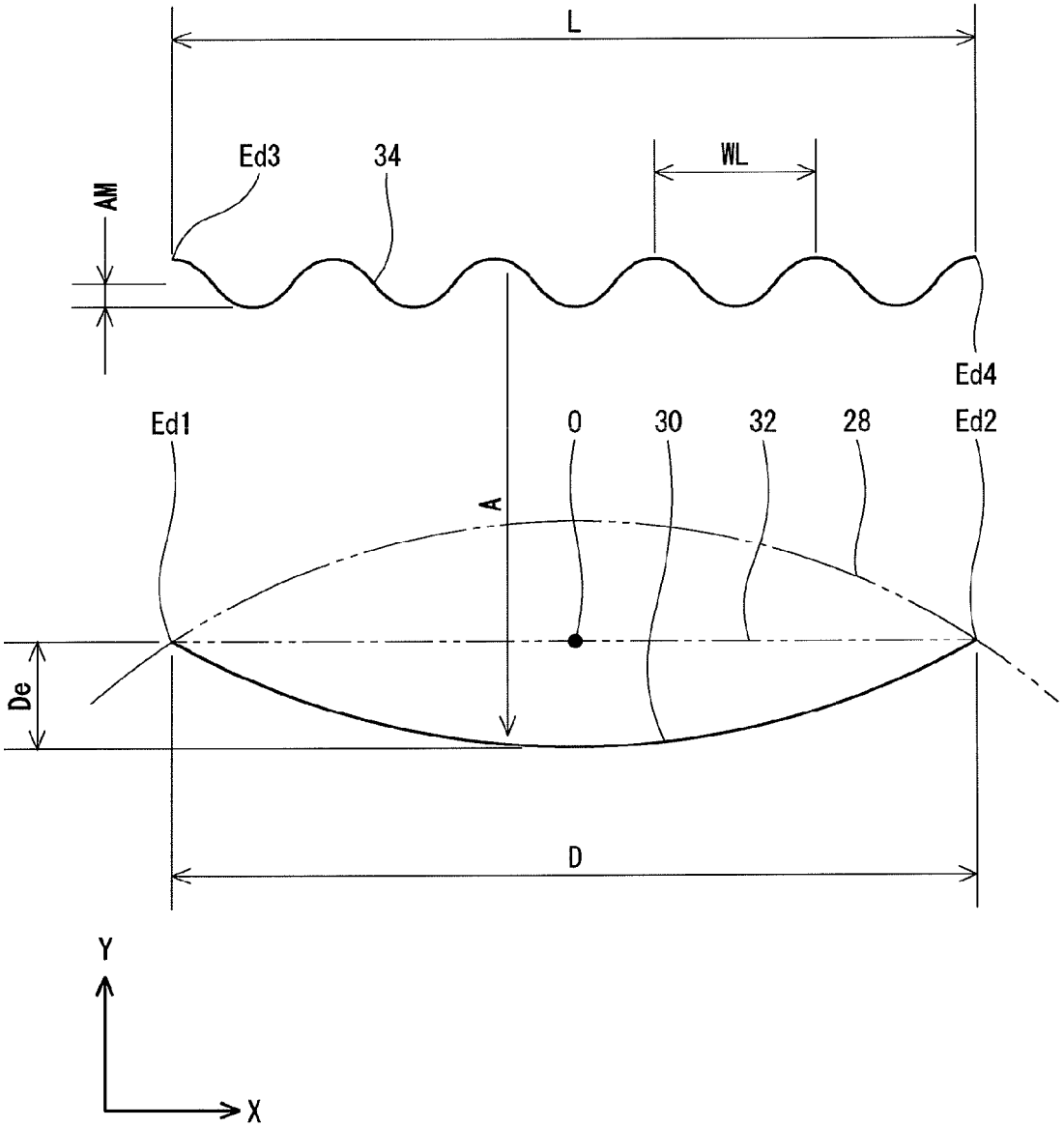
FIG. 6 is a view illustrating a method for designing the dimple in FIG. 5.

In a method for designing the dimple 8, a circle 28 is assumed on an X-Y plane indicated in FIG. 6. The radius of the circle 28 is the same as the radius of the phantom sphere 12 (see FIG. 5) of the golf ball 2. Further, on the X-Y plane, a circular arc 30 is assumed. The circular arc 30 has one end Ed1 and another end Ed2 that are present on the circle 28. The circular arc 30 is downwardly convex. In FIG. 6, what is indicated by an arrow D is the length of a chord 32 corresponding to the circular arc 30. The coordinate of an origin O of the X-Y plane is (0,0). The origin O is the midpoint of the chord 32. The y coordinate of a point on the circular arc 30 is represented by the following mathematical formula (1).

$$y=(R-d)-\sqrt{(R^2-x^2)} \quad (1)$$

In the mathematical formula (1), R denotes the curvature radius of the circular arc 30, and d denotes the depth of the circular arc 30.

As shown in FIG. 6, a cosine curve 34 is assumed on the X-Y plane. The cosine curve 34 is bilaterally symmetrical. The cosine curve 34 has one end Ed3 and another end Ed4. In FIG. 6, what is indicated by an arrow L is the length of the cosine curve 34; what is indicated by an arrow WL is the wavelength of the cosine curve 34; and what is indicated by an arrow AM is the amplitude of the cosine curve 34. The length L of the cosine curve 34 is the same as the length D of the chord 32. The number of cycles of the cosine curve 34 is 5.0. The cosine curve 34 is moved in the direction indicated by an arrow A. As a result of the movement, the end Ed3 of the cosine curve 34 agrees with the end Ed1 of the circular arc 30, and the other end Ed4 of the cosine curve 34 agrees with the other end Ed2 of the circular arc 30.

Figure 7:
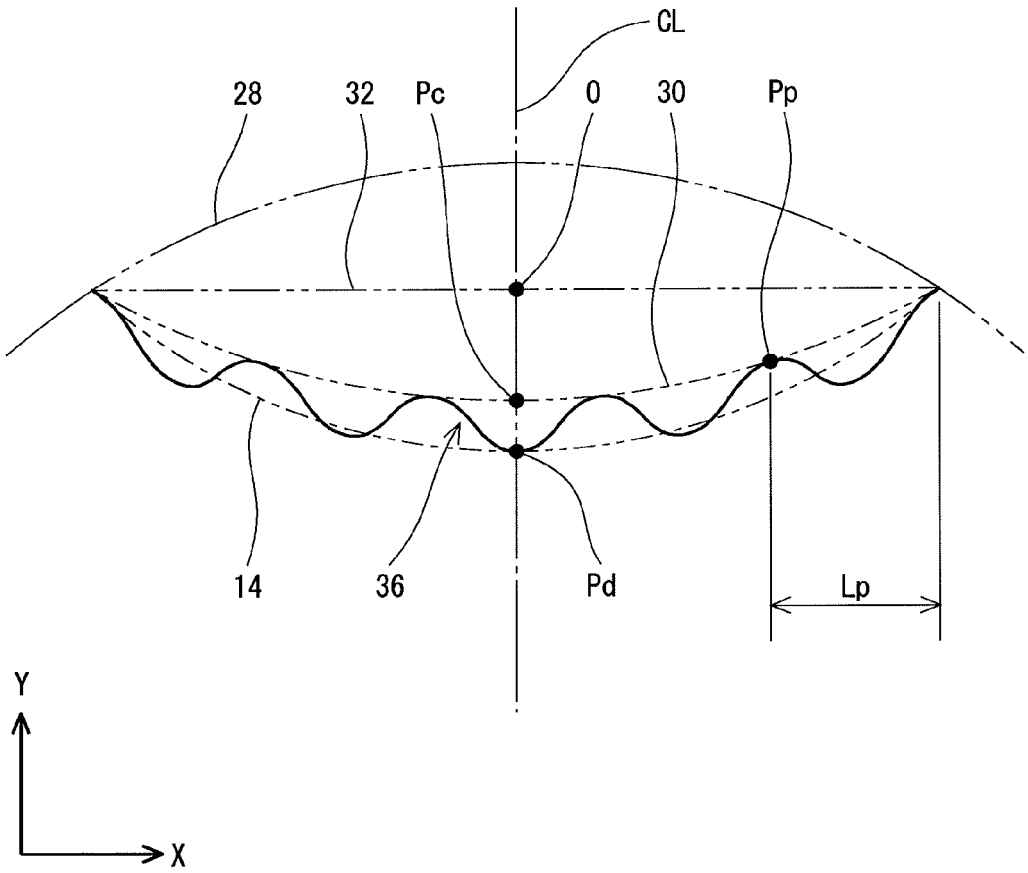
FIG. 7 is a view illustrating the method for designing the dimple in FIG. 5.

The circular arc 30 and the cosine curve 34 are combined with each other. As a result of the combination, a wave-like curve 36 is obtained. The wave-like curve 36 is shown in FIG. 7. The y coordinate of the wave-like curve 36 is represented by the following mathematical formula (2).

$$y = (R - d) - \sqrt{(R^2 - x^2)} + d \times Q \times \cos\left\{\left[\frac{\sin^{-1}\left(\frac{D}{2R}\right) + \sin^{-1}\left(\frac{x}{R}\right)}{\sin^{-1}\left(\frac{D}{2R}\right)}\right] \times \frac{S \times \pi}{180}\right\} \quad (2)$$

In the mathematical formula (2), Q denotes an amplitude adjustment coefficient, and S denotes a number of cycles adjustment coefficient. The coefficient Q is set as appropriate by taking into consideration a balance of the amplitude AM of the cosine curve 34 relative to the depth d of the circular arc 30. The coefficient S is set such that a desired number of cycles of the cosine curve 34 is achieved. In the cosine curve 34 shown in FIG. 6, S is 900. Thus, the number of cycles of the cosine curve 34 is 5.0.

In FIG. 7, what is indicated by a reference sign CL is a straight line passing through the central point Pc of the circular arc 30 and the origin O. The wave-like curve 36 is rotated 180 degrees about the straight line CL. On the basis of a trajectory through which the wave-like curve 36 passes by the rotation, a three-dimensional shape is obtained. The dimple 8 shown in FIG. 5 has this three-dimensional shape. The diameter Di of the dimple 8 is the same as the length D of the chord 32.

According to the finding by the inventor of the present invention, the dimple 8 having the projections and the recesses reduces drag when the golf ball 2 flies at a high speed. The drag is small at the initial stage of a trajectory of the golf ball 2. The dimple 8 having the projections and the recesses enhances a lift force when the golf ball 2 flies at a low speed. The lift force is great at the latter stage of the trajectory of the golf ball 2. By the golf ball 2, a long flight distance can be obtained.

In FIG. 5, what is indicated by a reference sign Pp is the peak of the projection closest to the edge Ed (namely, the first projection 16). The peak Pp is a point, on the surface of the first projection 16, which is located at the largest distance from the circular arc 14. This distance is measured in the depth direction of the dimple 8 (in the top-to-bottom direction in FIG. 5).

In FIG. 5, what is indicated by an arrow Lp is the distance from the edge Ed to the peak Pp. The ratio of the distance Lp to the radius (Di/2) of the dimple 8 is preferably equal to or greater than 20% but equal to or less than 70%. In a golf ball 2 having dimples 8 in each of which the ratio is equal to or greater than 20%, the drag is small at the initial stage of the trajectory. In this respect, the ratio is more preferably equal to or greater than 29% and particularly preferably equal to or greater than 40%. In a golf ball 2 having dimples 8 in each of which the ratio is equal to or less than 70%, the lift force is great at the latter stage of the trajectory. In this respect, the ratio is more preferably equal to or less than 60% and particularly preferably equal to or less than 49%.

In the dimple 8, one recess (namely, the first recess 20) is present between the edge Ed and the projection closest to the edge Ed (namely, the first projection 16). This first recess 20 contributes to a reduction of the drag at the initial stage of the trajectory.

The number of cycles of the wave-like curve 36 obtained by combining the circular arc 30 and the cosine curve 34 is the same as the number of cycles of the cosine curve 34. As described above, the number of cycles of the cosine curve 34 shown in FIG. 6 is 5.0. Thus, the number of cycles of the wave-like curve 36 shown in FIG. 7 is 5.0. In light of flight performance, the number of cycles of the wave-like curve 36 is preferably equal to or greater than 2.5 but equal to or less than 7.0. In light of flight performance, the number of the projections in the wave-like curve 36 is preferably equal to or greater than 3 but equal to or less than 7.

By the wave-like curve 36 symmetrical about the straight line CL being rotated, the dimple 8 can be formed so as not to have directional properties. The dimple 8 that does not have directional properties has excellent aerodynamic symmetry.

In light of flight performance, the ratio of the amplitude AM of the cosine curve 34 to the depth De of the circular arc 30 is preferably equal to or greater than 5% but equal to or less than 50%. The ratio is more preferably equal to or greater than 8% and particularly preferably equal to or greater than 10%. The ratio is more preferably equal to or less than 30% and particularly preferably equal to or less than 20%.

In light of flight performance, the ratio (WL/D) of the wavelength WL of the cosine curve 34 to the length D of the chord 32 is preferably equal to or greater than (1/7) but equal to or less than (1/2.5). The ratio (WL/D) is more preferably equal to or greater than (1/6). The ratio (WL/D) is more preferably equal to or less than (1/4).

The golf ball 2 may have: dimples 8 each having a curved surface whose cross-sectional shape is the wave-like curve 36; and other dimples 8. The ratio (N1/N) of the number N1 of the dimples 8 each having a curved surface whose cross-sectional shape is the wave-like curve 36, to the total number N of the dimples 8, is preferably equal to or greater than 0.3, more preferably equal to or greater than 0.5, and particularly preferably equal to or greater than 0.7. Ideally, the ratio (N1/N) is 1.0.

In light of suppression of rising of the golf ball 2 during flight, the depth De of the circular arc 30 is preferably equal to or greater than 0.05 mm, more preferably equal to or greater than 0.08 mm, and particularly preferably equal to or greater than 0.10 mm. In light of suppression of dropping of the golf ball 2 during flight, the depth De is preferably equal to or less than 0.60 mm, more preferably equal to or less than 0.45 mm, and particularly preferably equal to or less than 0.40 mm.

The area s of the dimple 8 is the area of a region surrounded by the contour line when the center of the golf ball 2 is viewed at infinity. In the case of a circular dimple 8, the area s is calculated by the following mathematical formula.

$$s=(Di/2)^2*\pi$$

In the golf ball 2 shown in FIGS. 1 to 7, the area of the dimple A is 15.62 $mm^2$; the area of the dimple B is 14.93 $mm^2$; and the area of the dimple C is 11.95 $mm^2$.

In the present invention, the ratio of the sum of the areas of all the dimples 8 to the surface area of the phantom sphere 12 is referred to as an occupation ratio. From the standpoint that a sufficient dimple effect is achieved, the occupation ratio is preferably equal to or greater than 70%, more preferably equal to or greater than 78%, and particularly preferably equal to or greater than 80%. The occupation ratio is preferably equal to or less than 90%. In the golf ball 2 shown in FIGS. 1 to 7, the total area of all the dimples 8 is 4676.4 $mm^2$. The surface area of the phantom sphere 12 of the golf ball 2 is 4629 $mm^2$, and thus the occupation ratio is 81.6%.

In the present invention, the term "dimple volume" means the volume of a part surrounded by the surface of the dimple 8 and a plane that includes the contour of the dimple 8. In light of suppression of rising of the golf ball 2 during flight, the total volume of all the dimples 8 is preferably equal to or greater than 250 $mm^3$, more preferably equal to or greater than 260 $mm^3$, and particularly preferably equal to or greater than 270 $mm^3$. In light of suppression of dropping of the golf ball 2 during flight, the total volume is preferably equal to or less than 400 $mm^3$, more preferably equal to or less than 390 $mm^3$, and particularly preferably equal to or less than 380 $mm^3$.

Instead of the cosine curve 34, a sine curve may be combined with the circular arc 30, to obtain a wave-like curve. In the case of using a sine curve, the circular arc 30 and the sine curve are assumed between the straight line CL (see FIG. 7) and one edge Ed. The sine curve and the circular arc 30 are combined with each other, to obtain a half-wave-like curve. The half-wave-like curve is inverted about the straight line CL, to obtain another half-wave-like curve. These two half-wave-like curves are combined with each other, to obtain a wave-like curve. The wave-like curve is rotated 180 degrees about the straight line CL. As a result of the rotation, a dimple having projections and recesses is obtained. The dimple reduces drag when a golf ball flies at a high speed. The drag is small at the initial stage of a trajectory of the golf ball. The dimple having the projections and the recesses enhances a lift force when the golf ball flies at a low speed. The lift force is great at the latter stage of the trajectory of the golf ball. By the golf ball, a long flight distance can be obtained.

In the dimple obtained by using the sine curve as well, the ratio of the distance Lp between the edge Ed and the peak of the projection closest to the edge Ed, to the radius (Di/2) of the dimple, is preferably equal to or greater than 20% but equal to or less than 70%. In a golf ball having dimples in each of which the ratio is equal to or greater than 20%, the drag is small at the initial stage of a trajectory. In this respect, the ratio is more preferably equal to or greater than 29% and particularly preferably equal to or greater than 40%. In a golf ball having dimples in each of which the ratio is equal to or less than 70%, the lift force is great at the latter stage of a trajectory. In this respect, the ratio is more preferably equal to or less than 60% and particularly preferably equal to or less than 49%.

In the dimple obtained by using the sine curve, in light of flight performance, the number of cycles of the wave-like curve is preferably equal to or greater than 2.0 but equal to or less than 6.0. In light of flight performance, the number of the projections in the wave-like curve is preferably equal to or greater than 3 but equal to or less than 7.

In the dimple obtained by using the sine curve as well, one recess is preferably present between the edge Ed and the projection closest to the edge Ed. In the dimple as well, the ratio of the amplitude AM of the sine curve to the depth De of the circular arc 30 is preferably equal to or greater than 5% but equal to or less than 50%. The ratio is more preferably equal to or greater than 8% and particularly preferably equal to or greater than 10%. The ratio is more preferably equal to or less than 30% and particularly equal to or less than 20%. In light of flight performance, the ratio (WL/D) of the wavelength WL of the sine curve to the length D of the chord 32 is preferably equal to or greater than (1/6) but equal to or less than (1/2). The ratio (WL/D) is more preferably equal to or greater than (1/5). The ratio (WL/D) is more preferably equal to or less than (1/4).

In the dimple obtained by using the sine curve as well, the depth De of the circular arc 30 is preferably equal to or greater than 0.05 mm, more preferably equal to or greater than 0.08 mm, and particularly preferably equal to or greater than 0.10 mm. The depth De is preferably equal to or less than 0.60 mm, more preferably equal to or less than 0.45 mm, and particularly preferably equal to or less than 0.40 mm.

In a golf ball having the dimples obtained by using the sine curve as well, the occupation ratio is preferably equal to or greater than 70%, more preferably equal to or greater than 78%, and particularly preferably equal to or greater than 80%. The occupation ratio is preferably equal to or less than 90%. The total volume of the dimples is preferably equal to or greater than 250 $mm^3$, more preferably equal to or greater than 260 $mm^3$, and particularly preferably equal to or greater than 270 $mm^3$. The total volume is preferably equal to or less than 400 $mm^3$, more preferably equal to or less than 390 $mm^3$, and particularly preferably equal to or less than 380 $mm^3$.

EXAMPLES

Example 1

A rubber composition was obtained by kneading 100 parts by weight of a high-cis polybutadiene (trade name "BR-730", manufactured by JSR Corporation), 28.0 parts by weight of zinc diacrylate, 5 parts by weight of zinc oxide, 16.1 parts by weight of barium sulfate, 0.2 parts by weight of 2-naphthalenethiol, and 0.9 parts by weight of dicumyl peroxide. This rubber composition was placed into a mold including upper and lower mold halves each having a hemispherical cavity, and heated at 170° C. for 25 minutes to obtain a core with a diameter of 39.6 mm.

A resin composition was obtained by kneading 49 parts by weight of an ionomer resin (the aforementioned "Surlyn 8945"), 48 parts by weight of another ionomer resin (the aforementioned "Himilan AM7329"), and 3 parts by weight of a styrene block-containing thermoplastic elastomer (the aforementioned "Rabalon T3221C") with a twin-screw kneading extruder. The core was placed into a final mold having a large number of pimples on its cavity face. The core was covered with the resin composition by injection molding to form a cover with a thickness of 1.6 mm. Dimples having a shape that was the inverted shape of the pimples were formed on the cover. A clear paint including a two-component curing type polyurethane as a base material was applied to this cover to obtain a golf ball of Example 1 with a diameter of 42.8 mm. A hardness distribution of the core of this golf ball is shown in Table 4 and FIG. 4. The total volume of the dimples of the golf ball is 320 $mm^3$. The golf ball has a dimple pattern shown in FIGS. 2 and 3. The golf ball has dimples A, B, and C. Each of the dimples A, B, and C has the cross-sectional shape shown in FIG. 4.

Examples 2 to 4 and 12 and Comparative Examples 1 and 2

Golf balls of Examples 2 to 4 and 12 and Comparative Examples 1 and 2 were obtained in the same manner as Example 1, except the final mold was changed. The details of a cross-sectional shape of each dimple are as follows.

Figure 8:
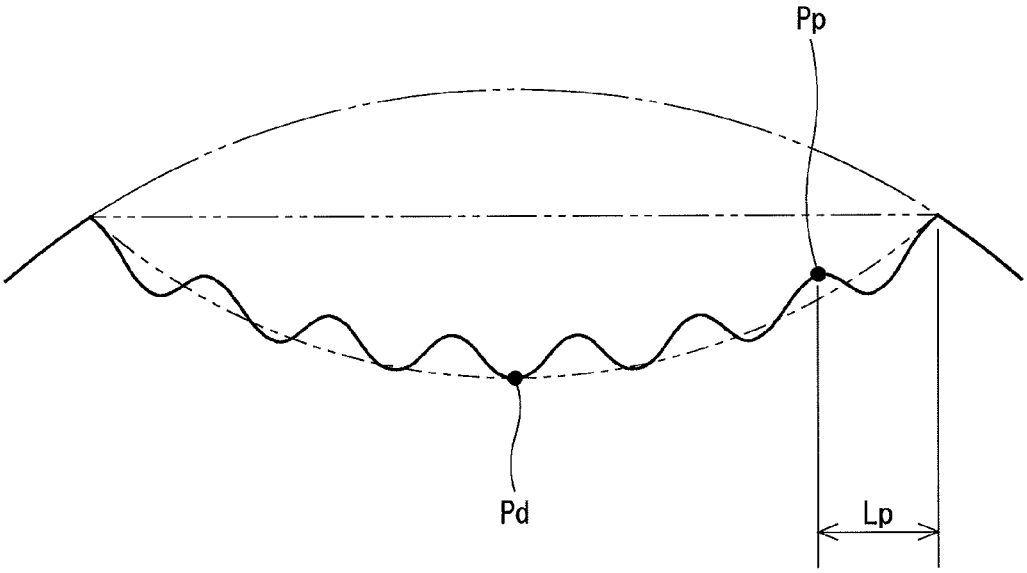
FIG. 8 is a cross-sectional view of a dimple of a golf ball according to Example 2 of the present invention.

Example 2 (FIG. 8): Combination of a circular arc and a cosine curve.

Figure 9:
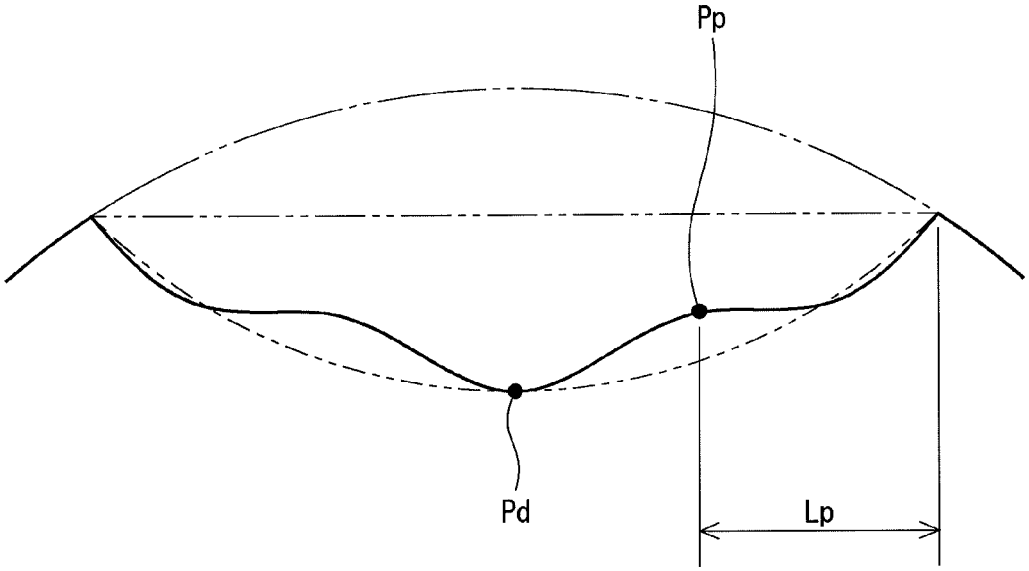
FIG. 9 is a cross-sectional view of a dimple of a golf ball according to Example 3 of the present invention.

Example 3 (FIG. 9): Combination of a circular arc and a sine curve.

Figure 10:
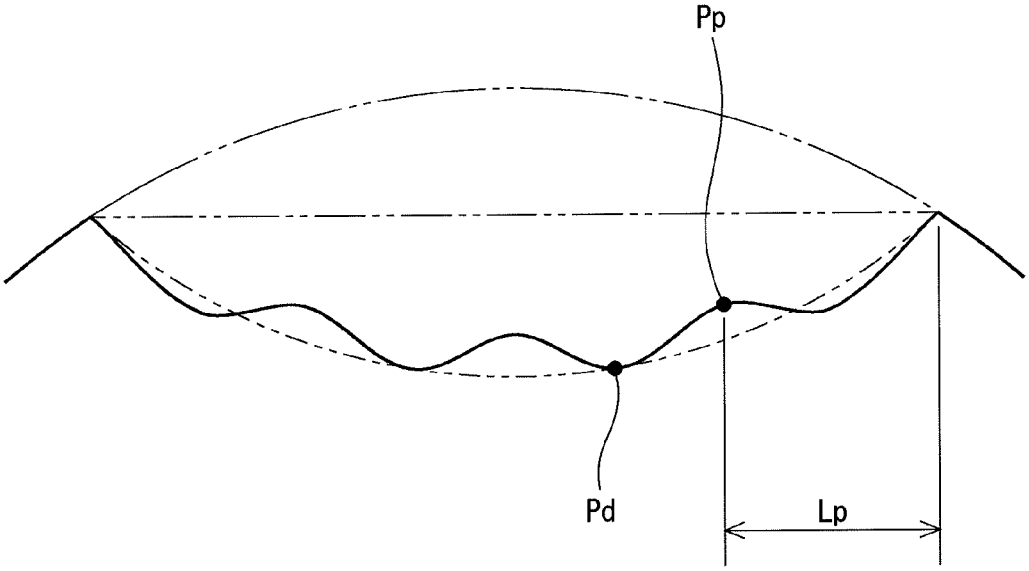
FIG. 10 is a cross-sectional view of a dimple of a golf ball according to Example 4 of the present invention.

Example 4 (FIG. 10): Combination of a circular arc and a cosine curve.

Figure 11:
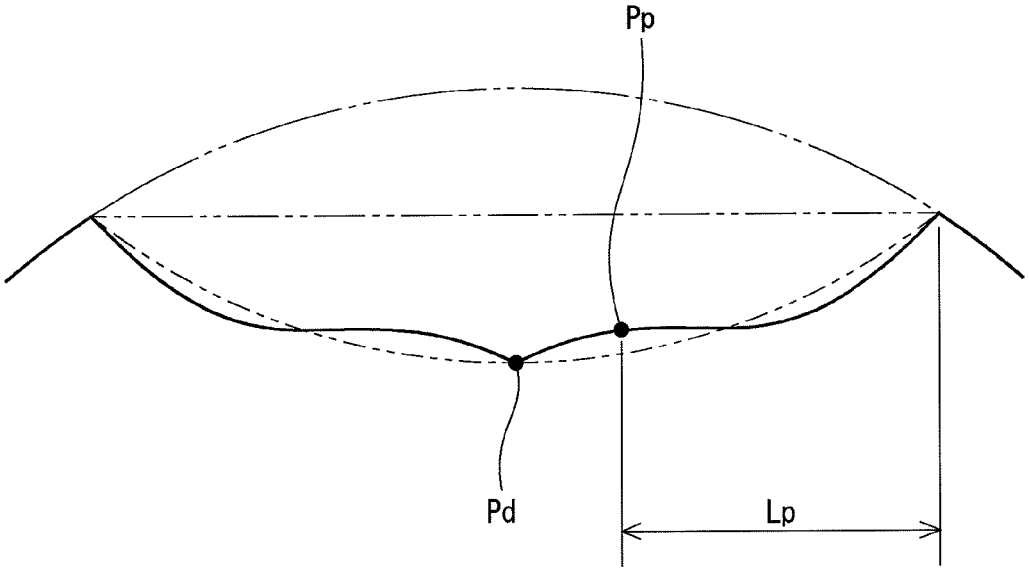
FIG. 11 is a cross-sectional view of a dimple of a golf ball according to Example 12 of the present invention.

Example 12 (FIG. 11): Combination of a circular arc and a sine curve.

Figure 12:
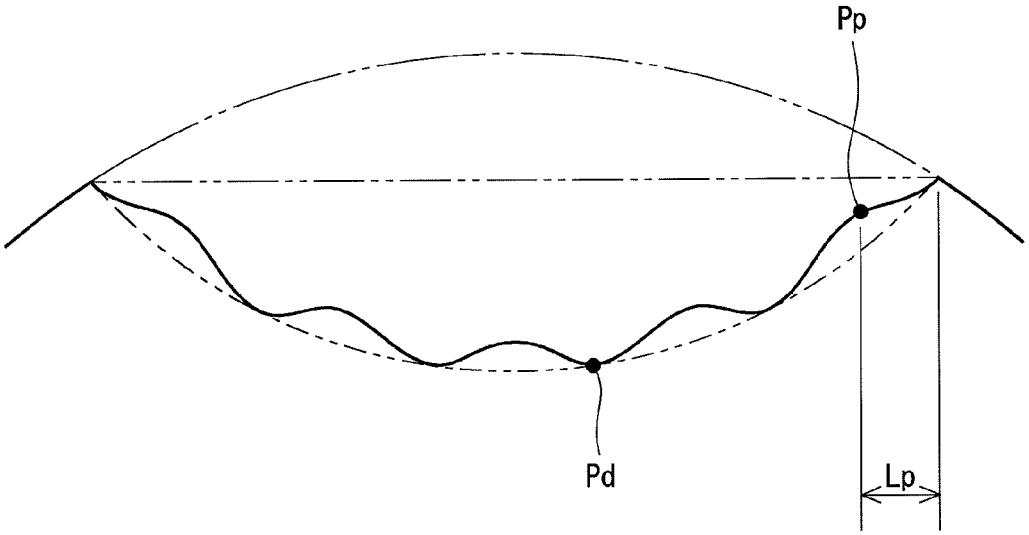
FIG. 12 is a cross-sectional view of a dimple of a golf ball according to Comparative Example 1 of the present invention.

Comparative Example 1 (FIG. 12): Combination of a circular arc and a cosine curve.

Figure 13:
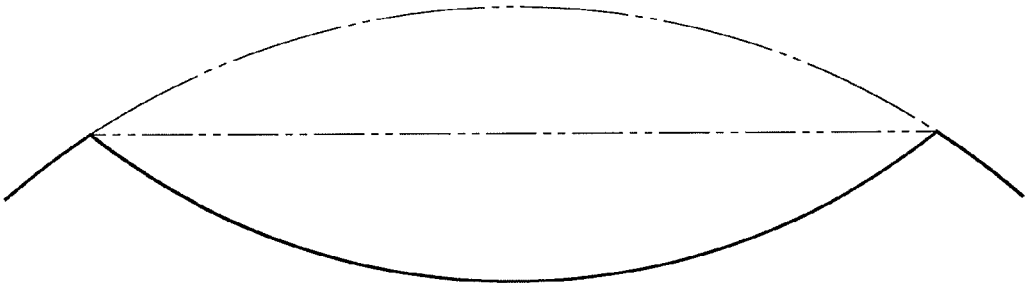
FIG. 13 is a cross-sectional view of a dimple of a golf ball according to Comparative Example 2 of the present invention.

Comparative Example 2 (FIG. 13): a circular arc (single radius).

Examples 5 and 6

Golf balls of Examples 5 and 6 were obtained in the same manner as Example 1, except the final mold was changed. In the golf ball of Example 5, a cross-sectional shape of each of dimples A and B is a wave-like shape, and a cross-sectional shape of each dimple C is a circular arc. In the golf ball of Example 6, a cross-sectional shape of each dimple A is a wave-like shape, and a cross-sectional shape of each of dimples B and C is a circular arc.

Examples 7 to 11, 13, and 14 and Comparative Examples 3 to 6

Golf balls of Examples 7 to 11, 13, and 14 and Comparative Examples 3 to 6 were obtained in the same manner as Example 1, except the composition and the crosslinking conditions of the core were changed. The ingredients of the rubber composition of the core are shown in Tables 1 to 3 below.

Comparative Example 7

A rubber composition was obtained by kneading 100 parts by weight of a high-cis polybutadiene (the aforementioned "BR-730"), 22.5 parts by weight of zinc diacrylate, 5 parts by weight of zinc oxide, 18.3 parts by weight of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 170° C. for 25 minutes to obtain a center with a diameter of 25.0 mm.

A rubber composition was obtained by kneading 100 parts by weight of a high-cis polybutadiene (the aforementioned "BR-730"), 34.0 parts by weight of zinc diacrylate, 5 parts by weight of zinc oxide, 13.8 parts by weight of barium sulfate, 0.5 parts by weight of diphenyl disulfide, and 0.9 parts by weight of dicumyl peroxide. Half shells were formed from this rubber composition. The center was covered with two half shells. The center and the half shells were placed into a mold including upper and lower mold halves each having a hemispherical cavity, and heated at 170° C. for 25 minutes to obtain a core with a diameter of 39.6 mm. The core consists of the center and an envelope layer. The core was covered with a cover in the same manner as Example 1. Further, a clear paint was applied in the same manner as Example 1, to obtain a golf ball of Comparative Example 7.

[Flight Test]

A driver with a titanium head (trade name "XXIO", manufactured by SRI Sports Limited, shaft hardness: S, loft angle: 10.0°) was attached to a swing machine manufactured by True Temper Co. A golf ball was hit under the condition of a head speed of 45 m/sec. The ball speed immediately after the hit and the distance from the launch point to the stop point were measured. In addition, the ball speed was also measured immediately after the hit. The average value of data obtained by 10 measurements is shown in Tables 9 to 13 below.

[Durability Test]

A golf ball was kept in the environment of 23° C. for 12 hours. A driver with a titanium head was attached to a swing machine manufactured by True Temper Co. The golf ball was repeatedly hit under the condition of a head speed of 45 m/sec. The number of hits required to break the golf ball was counted. An index of the average value of data obtained by 12 measurements is shown in Tables 9 to 13 below.

TABLE 1

Composition of Core (parts by weight)

| | Examples 1-6, 12 Comparative Examples | Example | | | |
|---|---|---|---|---|---|
| | 1-2 | 7 | 8 | 9 | 10 |
| Polybutadiene | 100 | 100 | 100 | 100 | 100 |
| Zinc diacrylate | 28.0 | 38.0 | 26.0 | 44.0 | 25.0 |
| Zinc oxide | 5.0 | 5.0 | 5.0 | 5.0 | 5.0 |
| Barium sulfate | 16.1 | 12.2 | 16.8 | 9.8 | 17.3 |
| 2-naphthalenethiol | 0.2 | 2.0 | 0.1 | 3.5 | 0.03 |
| Dicumyl peroxide | 0.9 | 0.9 | 0.9 | 0.9 | 0.9 |

TABLE 2

Composition of Core (parts by weight)

| | Example | | | Compara. Example | |
|---|---|---|---|---|---|
| | 11 | 13 | 14 | 3 | 4 |
| Polybutadiene | 100 | 100 | 100 | 100 | 100 |
| Zinc diacrylate | 28.0 | 26.5 | 40.0 | 29.0 | 29.5 |
| Zinc oxide | 5.0 | 5.0 | 5.0 | 5.0 | 5.0 |
| Barium sulfate | 16.1 | 15.9 | 10.5 | 15.7 | 14.3 |
| Bis(pentabromophenyl)disulfide | — | 0.5 | — | — | — |
| Diphenyl disulfide | — | — | — | 0.5 | — |
| 1-naphthalenethiol | 0.2 | — | — | — | — |
| 2-naphthalenethiol | — | — | — | — | 3.5 |
| Dicumyl peroxide | 0.9 | 0.9 | — | 0.9 | 0.9 |
| 1,1-di(t-butylperoxy)cyclohexane | — | — | 3.0 | — | — |
| 2,2'-methylenebis(4-methyl-6-t-butylphenol) | — | — | 0.1 | — | — |
| Zinc stearate | — | — | 5.0 | — | — |
| Sulfur | — | — | 0.1 | — | — |
| Zinc salt of pentachlorothiophenol | — | — | 0.5 | — | — |

TABLE 3

Composition of Core (parts by weight)

| | Comparative Example | | | |
|---|---|---|---|---|
| | | | 7 | |
| | 5 | 6 | Center | Envelope layer |
| Polybutadiene | 100 | 100 | 100 | 100 |
| Zinc diacrylate | 31.0 | 28.0 | 22.5 | 34.0 |
| Zinc oxide | 5.0 | 5.0 | 5.0 | 5.0 |
| Barium sulfate | 14.9 | 16.1 | 18.3 | 13.8 |
| Diphenyl disulfide | — | — | 0.5 | 0.5 |
| Pentachlorothiophenol | 0.6 | — | — | — |
| Dicumyl peroxide | 0.9 | 1.5 | 0.9 | 0.9 |

TABLE 3-continued

| Composition of Core | | | | |
|---|---|---|---|---|
| | (parts by weight) | | | |
| | Comparative Example | | | |
| | | | 7 | |
| | 5 | 6 | Center | Envelope layer |
| 2,2'-methylenebis(4-methyl-6-t-butylphenol) | — | 0.5 | — | — |

The details of the compounds listed in Tables 1 to 3 are as follows.

Bis(pentabromophenyl)disulfide: Sankyo Kasei Co., Ltd.

Diphenyl disulfide: Sumitomo Seika Chemicals Co., Ltd.

1-naphthalenethiol: Alfa Aesar.

2-naphthalenethiol: Tokyo Chemical Industry Co., Ltd.

Pentachlorothiophenol: Tokyo Chemical Industry Co., Ltd.

Dicumyl peroxide: NOF Corporation.

1,1-di(t-butylperoxy)cyclohexane: trade name "Perhexa C-40", manufactured by NOF Corporation.

2,2'-methylenebis(4-methyl-6-t-butylphenol): trade name "Nocrac NS-6", manufactured by Ouchi Shinko Chemical Industrial Co., Ltd.

Zinc stearate: NOF Corporation.

Sulfur: trade name "Sulfur Z", manufactured by Tsurumi Chemical Industry Co., Ltd.

TABLE 4

Figure 14:
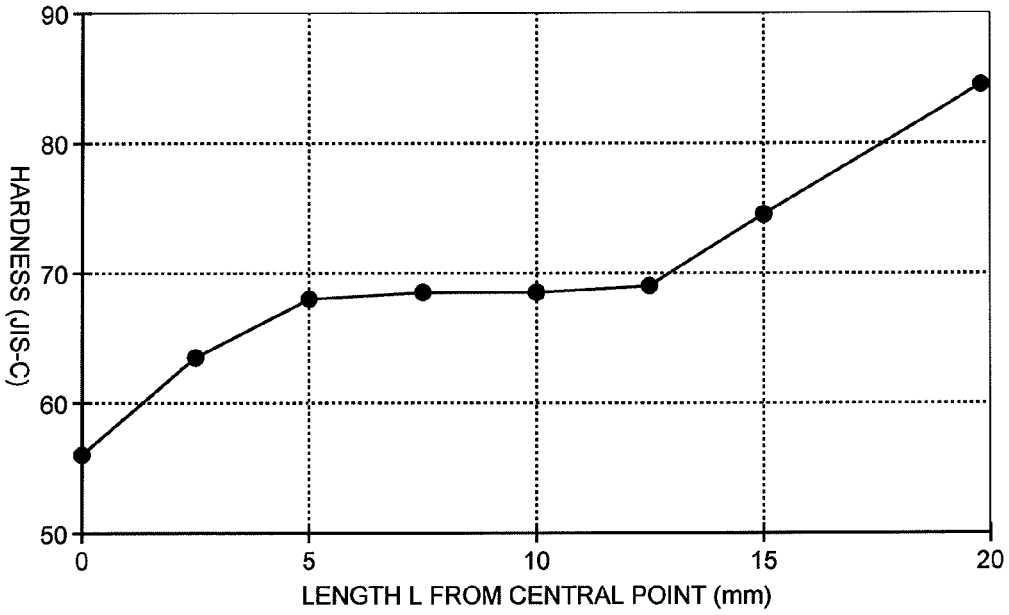
FIG. 14 is a graph showing a hardness distribution of a core of a golf ball according to Example 7 of the present invention.
Figure 15:
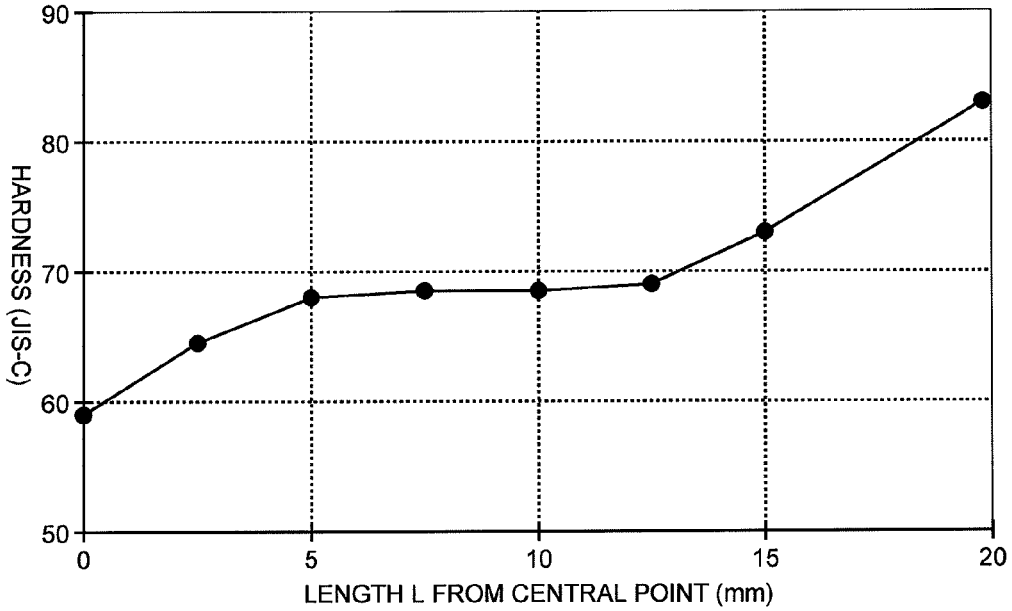
FIG. 15 is a graph showing a hardness distribution of a core of a golf ball according to Example 8 of the present invention.
Figure 16:
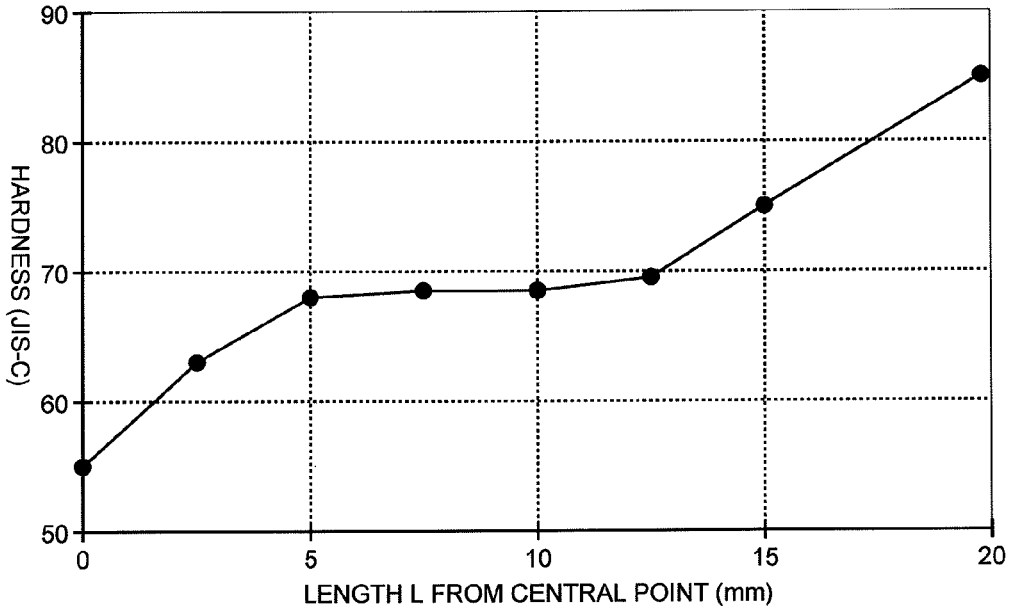
FIG. 16 is a graph showing a hardness distribution of a core of a golf ball according to Example 9 of the present invention.
Figure 17:
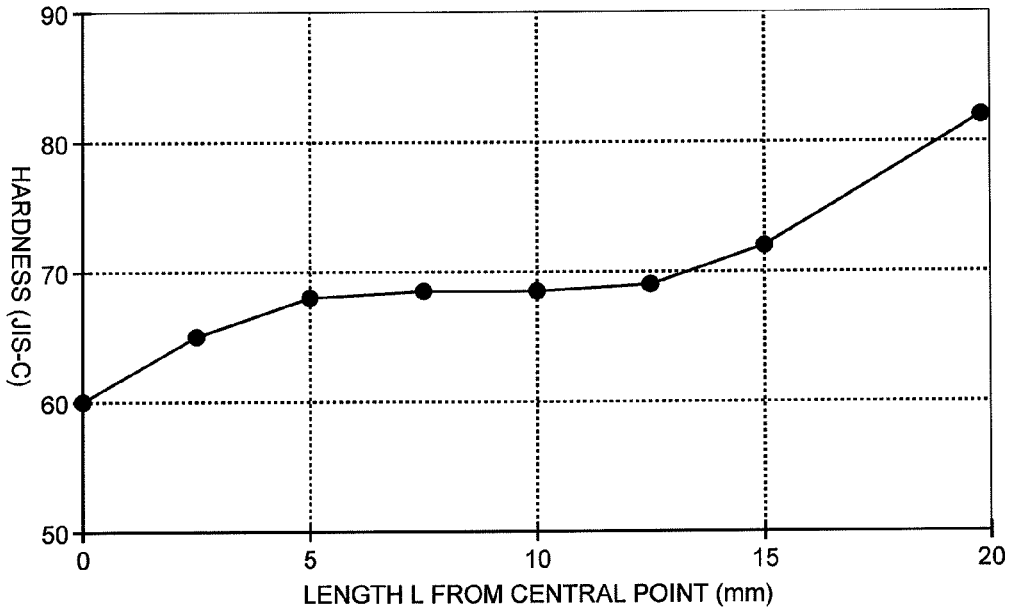
FIG. 17 is a graph showing a hardness distribution of a core of a golf ball according to Example 10 of the present invention.

| Specifications of Core | | | | | | |
|---|---|---|---|---|---|---|
| | | Examples 1-6, 12 Compa. Examples | Example | | | |
| | | 1-2 | 7 | 8 | 9 | 10 |
| Cross-linking conditions | Temperature (° C.) | 170 | 170 | 170 | 170 | 170 |
| | Time (min) | 25 | 25 | 25 | 25 | 25 |
| Diameter (mm) | | 39.6 | 39.6 | 39.6 | 39.6 | 39.6 |
| Hardness (JIS-C) | Ho | 57.0 | 56.0 | 59.0 | 55.0 | 60.0 |
| | H (2.5) | 64.0 | 63.5 | 64.5 | 63.0 | 65.0 |
| | H (5.0) | 68.0 | 68.0 | 68.0 | 68.0 | 68.0 |
| | H (7.5) | 68.5 | 68.5 | 68.5 | 68.5 | 68.5 |
| | H (10.0) | 68.5 | 68.5 | 68.5 | 68.5 | 68.5 |
| | H (12.5) | 69.0 | 69.0 | 69.0 | 69.5 | 69.0 |
| | H (12.6) | — | — | — | — | — |
| | H (15.0) | 74.0 | 74.5 | 73.0 | 75.0 | 72.0 |
| | Hs | 84.0 | 84.5 | 83.0 | 85.0 | 82.0 |
| | Graph | FIG. 4 | FIG. 14 | FIG. 15 | FIG. 16 | FIG. 17 |

TABLE 5

| Specifications of Core | | | | | | |
|---|---|---|---|---|---|---|
| | | Example | | | Compa. Example | |
| | | 11 | 13 | 14 | 3 | 4 |
| Cross-linking conditions | Temperature (° C.) | 170 | 170 | 160 | 170 | 155 |
| | Time (min) | 25 | 25 | 25 | 25 | 40 |

TABLE 5-continued

Figure 18:
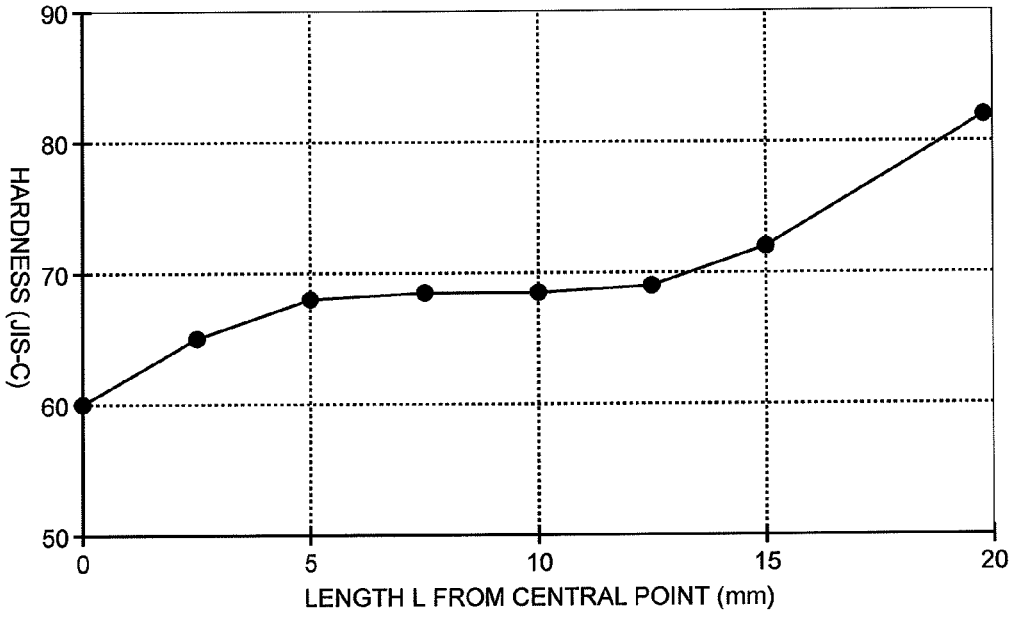
FIG. 18 is a graph showing a hardness distribution of a core of a golf ball according to Example 11 of the present invention.
Figure 19:
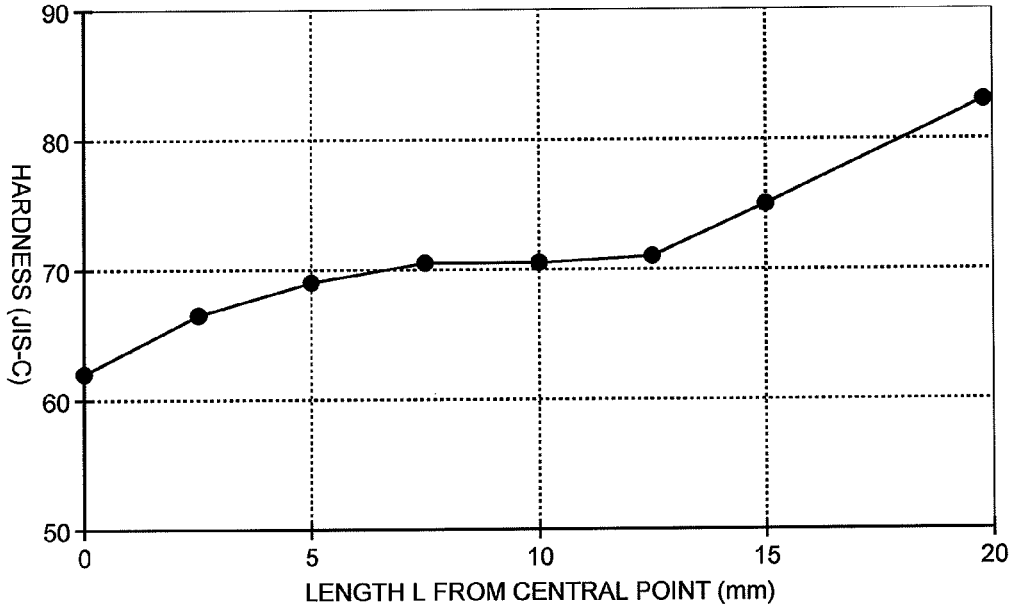
FIG. 19 is a graph showing a hardness distribution of a core of a golf ball according to Example 13 of the present invention.
Figure 20:
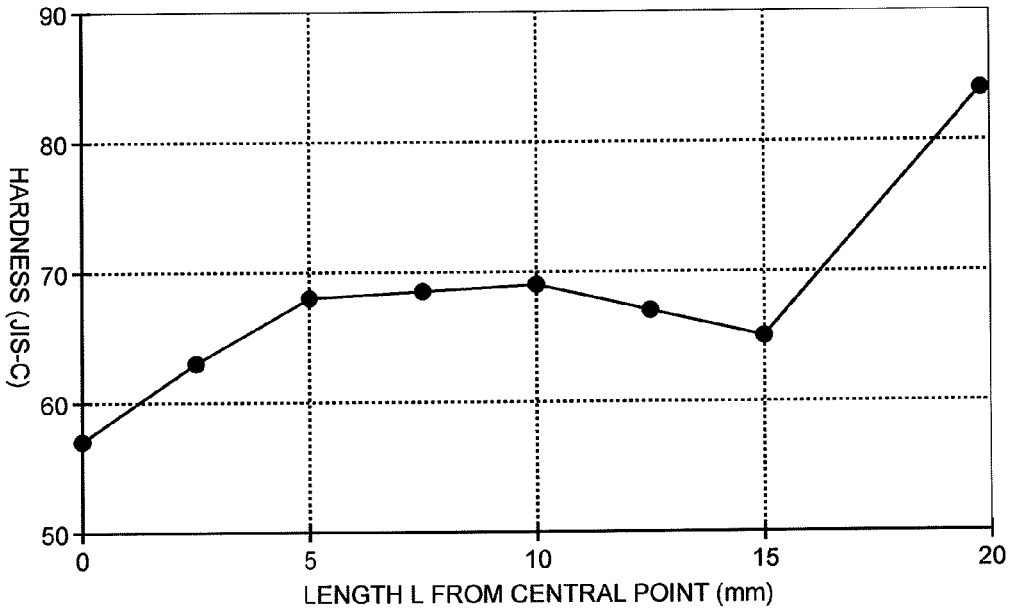
FIG. 20 is a graph showing a hardness distribution of a core of a golf ball according to Example 14 of the present invention.
Figure 21:
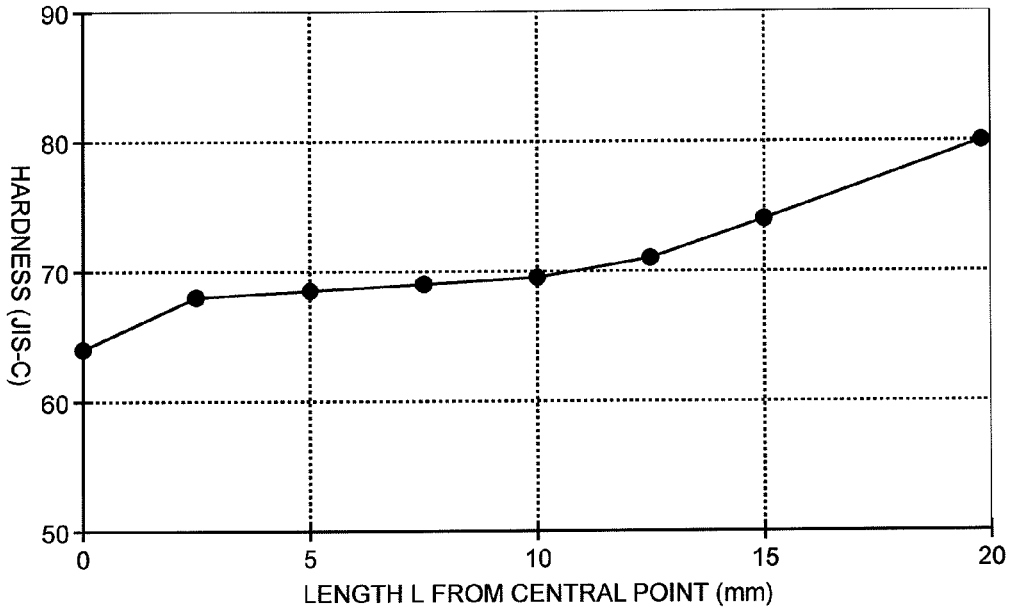
FIG. 21 is a graph showing a hardness distribution of a core of a golf ball according to Comparative Example 3.
Figure 22:
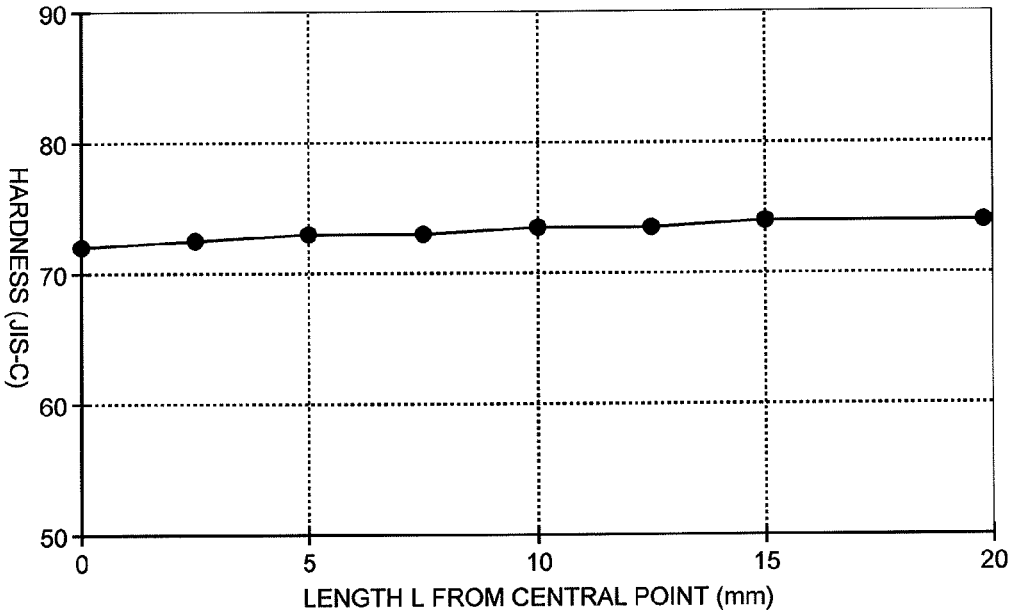
FIG. 22 is a graph showing a hardness distribution of a core of a golf ball according to Comparative Example 4.

| Specifications of Core | | | | | | |
|---|---|---|---|---|---|---|
| | | Example | | | Compa. Example | |
| | | 11 | 13 | 14 | 3 | 4 |
| Diameter (mm) | | 39.6 | 39.6 | 39.6 | 39.6 | 39.6 |
| Hardness (JIS-C) | Ho | 60.0 | 62.0 | 57.0 | 64.0 | 72.0 |
| | H (2.5) | 65.0 | 66.5 | 63.0 | 68.0 | 72.5 |
| | H (5.0) | 68.0 | 69.0 | 68.0 | 68.5 | 73.0 |
| | H (7.5) | 68.5 | 70.5 | 68.5 | 69.0 | 73.0 |
| | H (10.0) | 68.5 | 70.5 | 69.0 | 69.5 | 73.5 |
| | H (12.5) | 69.0 | 71.0 | 67.0 | 71.0 | 73.5 |
| | H (12.6) | — | — | — | — | — |
| | H (15.0) | 72.0 | 75.0 | 65.0 | 74.0 | 74.0 |
| | Hs | 82.0 | 83.0 | 84.0 | 80.0 | 74.0 |
| | Graph | FIG. 18 | FIG. 19 | FIG. 20 | FIG. 21 | FIG. 22 |

TABLE 6

Figure 23:
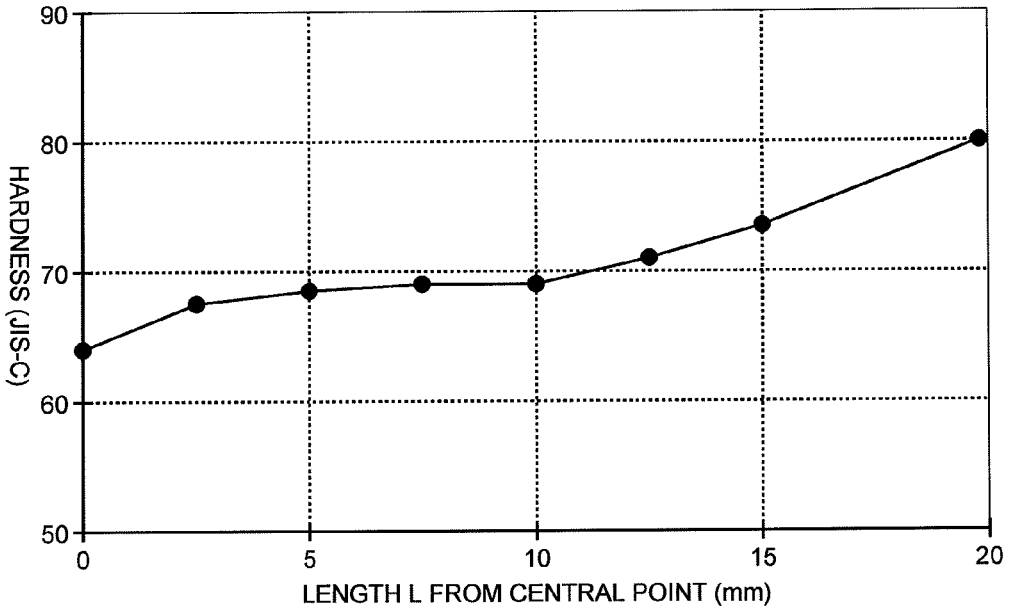
FIG. 23 is a graph showing a hardness distribution of a core of a golf ball according to Comparative Example 5.
Figure 24:
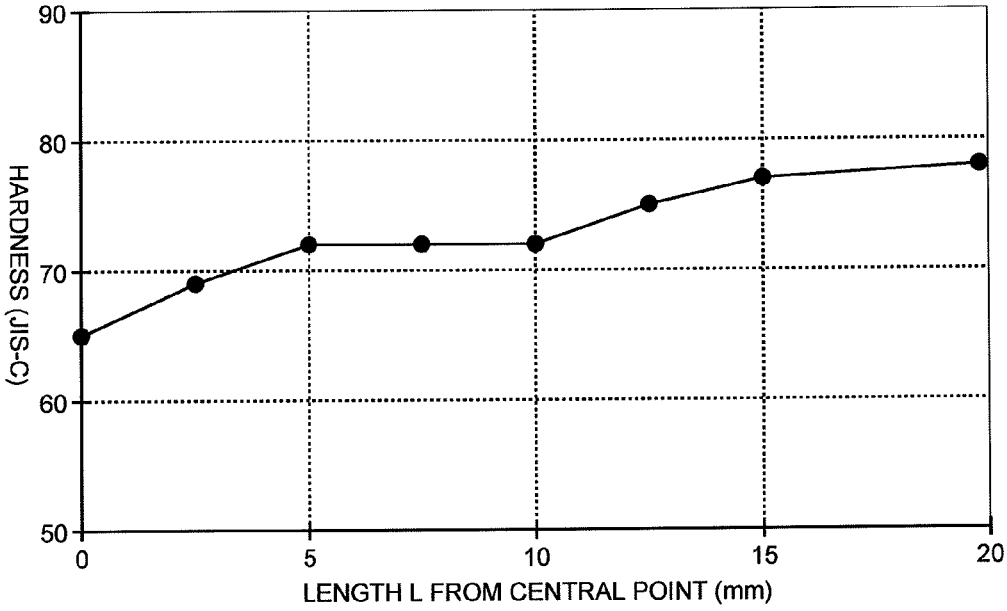
FIG. 24 is a graph showing a hardness distribution of a core of a golf ball according to Comparative Example 6.
Figure 25:
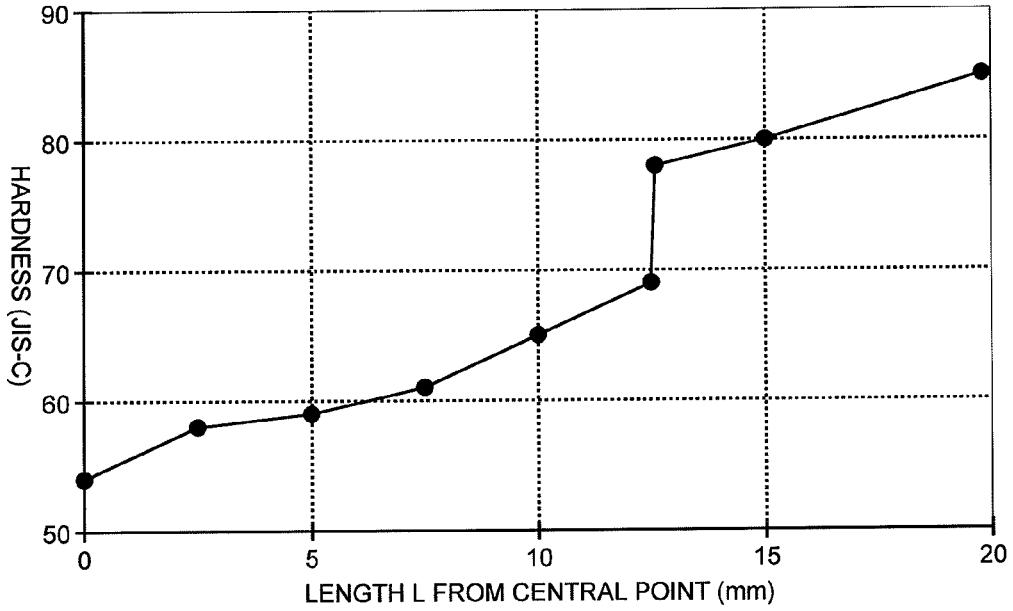
FIG. 25 is a graph showing a hardness distribution of a core of a golf ball according to Comparative Example 7.

| Specifications of Core | | | | | |
|---|---|---|---|---|---|
| | | | | Compara. Example 7 | |
| | | Compa. Example | | | Envelope |
| | | 5 | 6 | Center | layer |
| Crosslinking conditions | Temperature (° C.) | 170 | 162 | 170 | 170 |
| | Time (min) | 25 | 23 | 25 | 25 |
| Diameter (mm) | | 39.6 | 39.6 | 39.6 | |
| Hardness (JIS-C) | Ho | 64.0 | 65.0 | 54.0 | |
| | H (2.5) | 67.5 | 69.0 | 58.0 | |
| | H (5.0) | 68.5 | 72.0 | 59.0 | |
| | H (7.5) | 69.0 | 72.0 | 61.0 | |
| | H (10.0) | 69.0 | 72.0 | 65.0 | |
| | H (12.5) | 71.0 | 75.0 | 69.0 | |
| | H (12.6) | — | — | 78.0 | |
| | H (15.0) | 73.5 | 77.0 | 80.0 | |
| | Hs | 80.0 | 78.0 | 85.0 | |
| | Graph | FIG. 23 | FIG. 24 | FIG. 25 | |

TABLE 7

| Specifications of Dimples | | | | | |
|---|---|---|---|---|---|
| | | Examples 1, 7-11, 13, 14 Compa. Examples | Example | | |
| | | 3-7 | 2 | 3 | 4 |
| Dimple A | Diameter (mm) | 4.46 | 4.46 | 4.46 | 4.46 |
| | Total Number | 112 | 112 | 112 | 112 |
| | Shape | Wave FIG. 5 | Wave FIG. 8 | Wave FIG. 9 | Wave FIG. 10 |
| | Cycles | 5 | 7 | 2.5 | 4 |
| | Lp/(Di/2) (%) | 40 | 29 | 60 | 49 |
| | Projections | 4 | 6 | 2 | 3 |
| | Recesses | 4 | 6 | 2 | 2 |
| Dimple B | Diameter (mm) | 4.36 | 4.36 | 4.36 | 4.36 |
| | Total Number | 100 | 100 | 100 | 100 |
| | Shape | Wave FIG. 5 | Wave FIG. 8 | Wave FIG. 9 | Wave FIG. 10 |
| | Cycles | 5 | 7 | 2.5 | 4 |
| | Lp/(Di/2) (%) | 40 | 29 | 60 | 49 |
| | Projections | 4 | 6 | 2 | 3 |
| | Recesses | 4 | 6 | 2 | 2 |
| Dimple C | Diameter (mm) | 3.90 | 3.90 | 3.90 | 3.90 |
| | Total Number | 120 | 120 | 120 | 120 |
| | Shape | Wave-like FIG. 5 | Wave-like FIG. 8 | Wave-like FIG. 9 | Wave-like FIG. 10 |

TABLE 7-continued

| Specifications of Dimples | | Examples 1, 7-11, 13, 14 Compa. Examples | Example | | |
|---|---|---|---|---|---|
| | | 3-7 | 2 | 3 | 4 |
| | Cycles | 5 | 7 | 2.5 | 4 |
| | Lp/(Di/2) (%) | 40 | 29 | 60 | 49 |
| | Projections | 4 | 6 | 2 | 3 |
| | Recesses | 4 | 6 | 2 | 2 |

TABLE 8

| Specifications of Dimples | | Example | | | Compa. Example | |
|---|---|---|---|---|---|---|
| | | 5 | 6 | 12 | 1 | 2 |
| Dimple A | Diameter (mm) | 4.46 | 4.46 | 4.46 | 4.46 | 4.46 |
| | Total Number | 112 | 112 | 112 | 112 | 112 |
| | Shape | Wave FIG. 5 | Wave FIG. 5 | Wave FIG. 11 | Wave FIG. 12 | Arc FIG. 13 |
| | Cycles | 5 | 5 | 2 | 5 | — |
| | Lp/(Di/2) (%) | 40 | 40 | 76 | 18 | — |
| | Projections | 4 | 4 | 2 | 5 | 0 |
| | Recesses | 4 | 4 | 2 | 0 | 0 |
| Dimple B | Diameter (mm) | 4.36 | 4.36 | 4.36 | 4.36 | 4.36 |
| | Total Number | 100 | 100 | 100 | 100 | 100 |
| | Shape | Wave FIG. 5 | Arc FIG. 13 | Wave FIG. 11 | Wave FIG. 12 | Arc FIG. 13 |
| | Cycles | 5 | — | 2 | 5 | — |
| | Lp/(Di/2) (%) | 40 | — | 76 | 18 | — |
| | Projections | 4 | 0 | 2 | 5 | 0 |
| | Recesses | 4 | 0 | 2 | 0 | 0 |
| Dimple C | Diameter (mm) | 3.90 | 3.90 | 3.90 | 3.90 | 3.90 |
| | Total Number | 120 | 120 | 120 | 120 | 120 |
| | Shape | Arc FIG. 13 | Arc FIG. 13 | Wave FIG. 11 | Wave FIG. 12 | Arc FIG. 13 |
| | Cycles | — | — | 2 | 5 | — |
| | Lp/(Di/2) (%) | — | — | 76 | 18 | — |
| | Projections | 0 | 0 | 2 | 5 | 0 |
| | Recesses | 0 | 0 | 2 | 0 | 0 |

TABLE 9

| Results of Evaluation | | Example | | | | |
|---|---|---|---|---|---|---|
| | | 1 | 2 | 3 | 4 | 5 |
| H (5.0) - Ho | | 11.0 | 11.0 | 11.0 | 11.0 | 11.0 |
| H (12.5) - H (5.0) | | 1.0 | 1.0 | 1.0 | 1.0 | 1.0 |
| Hs - H (12.5) | | 15.0 | 15.0 | 15.0 | 15.0 | 15.0 |
| Hs - Ho | | 27.0 | 27.0 | 27.0 | 27.0 | 27.0 |
| Lp/(Di/2) (%) | Dimple A | 40 | 29 | 60 | 49 | 40 |
| | Dimple B | 40 | 29 | 60 | 49 | 40 |
| | Dimple C | 40 | 29 | 60 | 49 | — |
| Number of projections | Dimple A | 4 | 6 | 2 | 3 | 4 |
| | Dimple B | 4 | 6 | 2 | 3 | 4 |
| | Dimple C | 4 | 6 | 2 | 3 | 0 |
| Number of recesses | Dimple A | 4 | 6 | 2 | 2 | 4 |
| | Dimple B | 4 | 6 | 2 | 2 | 4 |
| | Dimple C | 4 | 6 | 2 | 2 | 0 |
| Deformation CD (mm) | | 3.2 | 3.2 | 3.2 | 3.2 | 3.2 |
| Ball speed (m/s) | | 64.8 | 64.8 | 64.8 | 64.8 | 64.8 |
| Flight distance (m) | | 235.5 | 235.0 | 234.5 | 235.5 | 235.0 |
| Durability | | 98 | 98 | 98 | 98 | 98 |

TABLE 10

| Results of Evaluation | | Example | | | |
|---|---|---|---|---|---|
| | | 6 | 7 | 8 | 9 |
| H(5.0) − Ho | | 11.0 | 12.0 | 9.0 | 13.0 |
| H(12.5) − H(5.0) | | 1.0 | 1.0 | 1.0 | 1.5 |
| Hs − H(12.5) | | 15.0 | 15.5 | 14.0 | 15.5 |
| Hs − Ho | | 27.0 | 20.5 | 24.0 | 30.0 |
| Lp/(Di/2) (%) | Dimple A | 40 | 40 | 40 | 40 |
| | Dimple B | — | 40 | 40 | 40 |
| | Dimple C | — | 40 | 40 | 40 |
| Number of projections | Dimple A | 4 | 4 | 4 | 4 |
| | Dimple B | 0 | 4 | 4 | 4 |
| | Dimple C | 0 | 4 | 4 | 4 |
| Number of recesses | Dimple A | 4 | 4 | 4 | 4 |
| | Dimple B | 0 | 4 | 4 | 4 |
| | Dimple C | 0 | 4 | 4 | 4 |
| Deformation CD (mm) | | 3.2 | 3.2 | 3.2 | 3.2 |
| Ball speed (m/s) | | 64.0 | 64.6 | 64.7 | 64.5 |
| Flight distance (m) | | 234.0 | 234.5 | 233.5 | 233.5 |
| Durability | | 98 | 97 | 99 | 95 |

TABLE 11

| Results of Evaluation | | Example | | | |
|---|---|---|---|---|---|
| | | 10 | 11 | 12 | 13 |
| H(5.0) − Ho | | 8.0 | 8.0 | 11.0 | 7.0 |
| H(12.5) − H(5.0) | | 1.0 | 1.0 | 1.0 | 2.0 |
| Hs − H(12.5) | | 13.0 | 13.0 | 15.0 | 12.0 |
| Hs − Ho | | 22.0 | 22.0 | 27.0 | 21.0 |
| Lp/(Di/2) (%) | Dimple A | 40 | 40 | 76 | 40 |
| | Dimple B | 40 | 40 | 76 | 40 |
| | Dimple C | 40 | 40 | 76 | 40 |
| Number of projections | Dimple A | 4 | 4 | 2 | 4 |
| | Dimple B | 4 | 4 | 2 | 4 |
| | Dimple C | 4 | 4 | 2 | 4 |
| Number of recesses | Dimple A | 4 | 4 | 2 | 4 |
| | Dimple B | 4 | 4 | 2 | 4 |
| | Dimple C | 4 | 4 | 2 | 4 |
| Deformation CD (mm) | | 3.2 | 3.2 | 3.2 | 3.2 |
| Ball speed (m/s) | | 64.7 | 64.7 | 64.8 | 64.8 |
| Flight distance (m) | | 232.5 | 232.5 | 233.0 | 230.5 |
| Durability | | 99 | 99 | 98 | 100 |

TABLE 12

| Results of Evaluation | | Example | Comparative Example | | |
|---|---|---|---|---|---|
| | | 14 | 1 | 2 | 3 |
| H(5.0) − Ho | | 11.0 | 11.0 | 11.0 | 4.5 |
| H(12.5) − H(5.0) | | −1.0 | 1.0 | 1.0 | 2.5 |
| Hs − H(12.5) | | 17.0 | 15.0 | 15.0 | 9.0 |
| Hs − Ho | | 27.0 | 27.0 | 27.0 | 16.0 |
| Lp/(Di/2) (%) | Dimple A | 40 | 18 | — | 40 |
| | Dimple B | 40 | 18 | — | 40 |
| | Dimple C | 40 | 18 | — | 40 |
| Number of projections | Dimple A | 4 | 5 | 0 | 4 |
| | Dimple B | 4 | 5 | 0 | 4 |
| | Dimple C | 4 | 5 | 0 | 4 |
| Number of recesses | Dimple A | 4 | 0 | 0 | 4 |
| | Dimple B | 4 | 0 | 0 | 4 |
| | Dimple C | 4 | 0 | 0 | 4 |
| Deformation CD (mm) | | 3.2 | 3.2 | 3.2 | 3.2 |
| Ball speed (m/s) | | 64.0 | 64.8 | 64.8 | 64.5 |

TABLE 12-continued

| Results of Evaluation | Example | Comparative Example | | |
|---|---|---|---|---|
| | 14 | 1 | 2 | 3 |
| Flight distance (m) | 222.5 | 233.5 | 233.0 | 227.5 |
| Durability | 95 | 98 | 98 | 100 |

TABLE 13

| Results of Evaluation | | Comparative Example | | | |
|---|---|---|---|---|---|
| | | 4 | 5 | 6 | 7 |
| H(5.0) − Ho | | 1.0 | 4.5 | 7.0 | 5.0 |
| H(12.5) − H(5.0) | | 0.5 | 2.5 | 3.0 | 10.0 |
| Hs − H(12.5) | | 0.5 | 9.0 | 3.0 | 16.0 |
| Hs − Ho | | 2.0 | 16.0 | 13.0 | 31.0 |
| Lp/(Di/2) (%) | Dimple A | 40 | 40 | 40 | 40 |
| | Dimple B | 40 | 40 | 40 | 40 |
| | Dimple C | 40 | 40 | 40 | 40 |
| Number of projections | Dimple A | 4 | 4 | 4 | 4 |
| | Dimple B | 4 | 4 | 4 | 4 |
| | Dimple C | 4 | 4 | 4 | 4 |
| Number of recesses | Dimple A | 4 | 4 | 4 | 4 |
| | Dimple B | 4 | 4 | 4 | 4 |
| | Dimple C | 4 | 4 | 4 | 4 |
| Deformation CD (mm) | | 3.2 | 3.2 | 3.2 | 3.2 |
| Ball speed (m/s) | | 65.0 | 64.5 | 64.0 | 64.3 |
| Flight distance (m) | | 225.5 | 226.5 | 221.5 | 232.5 |
| Durability | | 120 | 100 | 105 | 60 |

As shown in Tables 9 to 13, the golf balls according to Examples are excellent in various performance characteristics. From the results of evaluation, advantages of the present invention are clear.

The golf ball according to the present invention can be used for playing golf on a golf course and practicing at a driving range. The above description is merely for illustrative examples, and various modifications can be made without departing from the principles of the present invention.

What is claimed is:

1. A golf ball comprising a core and a cover positioned outside the core, and having dimples on a surface thereof, wherein a difference between a JIS-C hardness H(5.0) at a point that is located at a distance of 5 mm from a central point of the core, and a JIS-C hardness Ho at the central point is equal to or greater than 6.0, a difference between a JIS-C hardness H(12.5) at a point that is located at a distance of 12.5 mm from the central point, and the hardness H(5.0) is equal to or less than 4.0, a difference between a JIS-C hardness Hs at a surface of the core and the hardness H(12.5) is equal to or greater than 10.0, each dimple has a curved surface, and a cross-sectional shape of the curved surface is a wave-like curve having:

(1) 3 to 7 projections located above a circular arc that passes through one dimple edge, a deepest point of the dimple, and another dimple edge; and (2) two or more recesses located below the circular arc.

2. The golf ball according to claim 1, wherein a ratio of a distance between the dimple edge and a peak of a projection closest to the dimple edge, to a radius of the dimple, is equal to or greater than 20% but equal to or less than 70%.

3. The golf ball according to claim 1, wherein one recess is present between the dimple edge and a projection closest to the dimple edge.

4. The golf ball according to claim 1, wherein the wave-like curve is obtained by combining a sine curve and a circular arc.

5. The golf ball according to claim 4, wherein a number of cycles of the wave-like curve is equal to or greater than 2.0 but equal to or less than 6.0.

6. The golf ball according to claim 4, wherein a ratio (WL/D) of a wavelength WL of the sine curve to a length D of a chord of the circular arc is equal to or greater than 1/6 but equal to or less than 1/2.

7. The golf ball according to claim 1, wherein the wave-like curve is obtained by combining a cosine curve and a circular arc.

8. The golf ball according to claim 7, wherein a number of cycles of the wave-like curve is equal to or greater than 2.5 but equal to or less than 7.0.

9. The golf ball according to claim 7, wherein a ratio of an amplitude of the cosine curve to a depth of the circular arc is equal to or greater than 5% but equal to or less than 50%.

10. The golf ball according to claim 7, wherein a ratio (WL/D) of a wavelength WL of the cosine curve to a length D of a chord of the circular arc is equal to or greater than 1/7 but equal to or less than 1/2.5.

11. The golf ball according to claim 1, wherein a difference between the hardness Hs and the hardness Ho is equal to or greater than 22.0.

12. The golf ball according to claim 1, wherein there is no zone in which a hardness decreases from the central point toward the surface of the core.

13. The golf ball according to claim 1, wherein the core is formed by crosslinking a rubber composition including a base rubber and an organic sulfur compound, and the organic sulfur compound has a molecular weight of 150 or higher but 200 or lower and a melting point of 65° C. or higher but 90° C. or lower.

14. The golf ball according to claim 13, wherein the rubber composition includes the base rubber in an amount of 100 parts by weight, and the organic sulfur compound in an amount that is equal to or greater than 0.03 parts by weight but equal to or less than 3.5 parts by weight.

15. The golf ball according to claim 13, wherein the sulfur compound is 2-naphthalenethiol.

16. The golf ball according to claim 1, wherein the hardness Ho is equal to or greater than 40.0 but equal to or less than 70.0, and the hardness Hs is equal to or greater than 78.0 but equal to or less than 95.0.

17. The golf ball according to claim 1, wherein the hardness H(5.0) is equal to or greater than 63.0 but equal to or less than 73.0.

18. The golf ball according to claim 1, wherein the hardness H(12.5) is equal to or greater than 64.0 but equal to or less than 76.0.

19. The golf ball according to claim 2, wherein a ratio of a distance between the dimple edge and a peak of a projection closest to the dimple edge, to a radius of the dimple, is equal to or greater than 29% but equal to or less than 60%.

* * * * *